US011613864B2

(12) United States Patent
Halliwell

(10) Patent No.: US 11,613,864 B2
(45) Date of Patent: Mar. 28, 2023

(54) SECANT CONCRETE SHORING USING HELICAL PILES FOR DEPTH

(71) Applicant: HC Properties inc., Clinton (CA)

(72) Inventor: John Martin Halliwell, Clinton (CA)

(73) Assignee: HC Properties Inc., Goderich (CA)

( * ) Notice: Subject to any disclaimer, the term of this patent is extended or adjusted under 35 U.S.C. 154(b) by 70 days.

(21) Appl. No.: 17/237,544

(22) Filed: Apr. 22, 2021

(65) Prior Publication Data

US 2022/0341118 A1 Oct. 27, 2022

(51) Int. Cl.
*E02D 5/34* (2006.01)
*E02D 5/52* (2006.01)
*E02D 5/56* (2006.01)

(52) U.S. Cl.
CPC ..... *E02D 5/523* (2013.01); *E02D 5/34* (2013.01); *E02D 5/56* (2013.01)

(58) Field of Classification Search
CPC combination set(s) only.
See application file for complete search history.

(56) References Cited

U.S. PATENT DOCUMENTS 1,665,798 A * 4/1928 Sipe ..... E02D 5/18 405/240
4,909,675 A * 3/1990 Taki ..... E02D 5/20 405/269
7,921,573 B1 * 4/2011 Mancini ..... E02D 23/08 33/302
2021/0002845 A1 * 1/2021 Jones ..... E02D 29/0266

* cited by examiner

*Primary Examiner* — Kyle Armstrong
(74) *Attorney, Agent, or Firm* — Teitelbaum & Bouevitch; Neil Teitelbaum

(57) ABSTRACT

A pile shoring wall includes tangent concrete piles that are formed in the ground at an excavation site. The tangent concrete piles include a plurality of a first type of concrete piles in the ground at depths wherein the average depth is $d_1$ and a plurality of a second type of concrete piles. The second type of concrete piles includes 10% and less than 50% of the tangent concrete piles, and each have a shaft of a helical pile secured therewithin. Each helical pile has a bottom portion with helical flights for screwing the helical pile into the ground, and each helical pile is set into the ground to a depth of at least about 2 m below $d_1$. The helical flights of each helical pile are exposed to the surrounding soil and increase resistance below an excavation depth when the site is excavated.

6 Claims, 19 Drawing Sheets

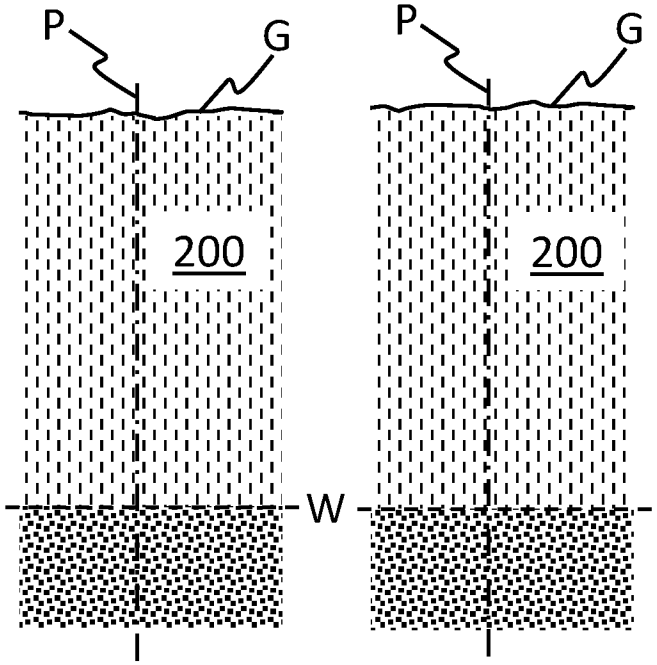
FIG. 2C
FIG. 2B
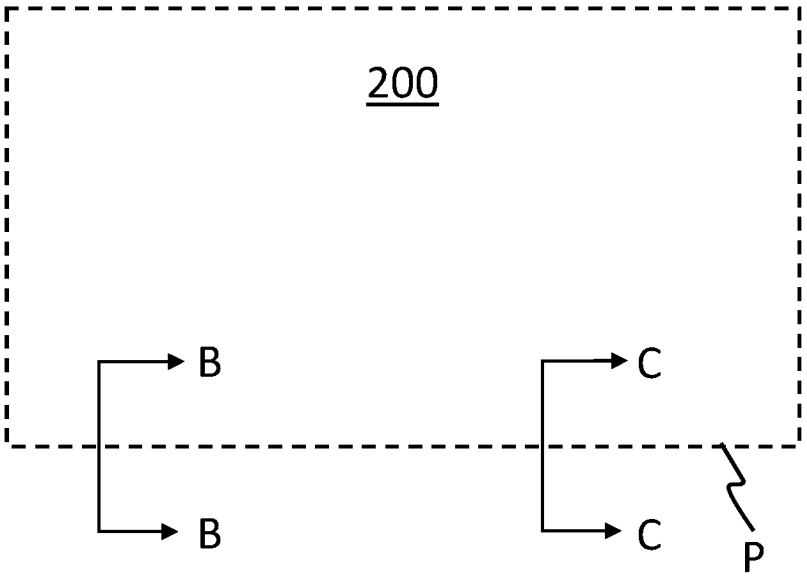
FIG. 2A

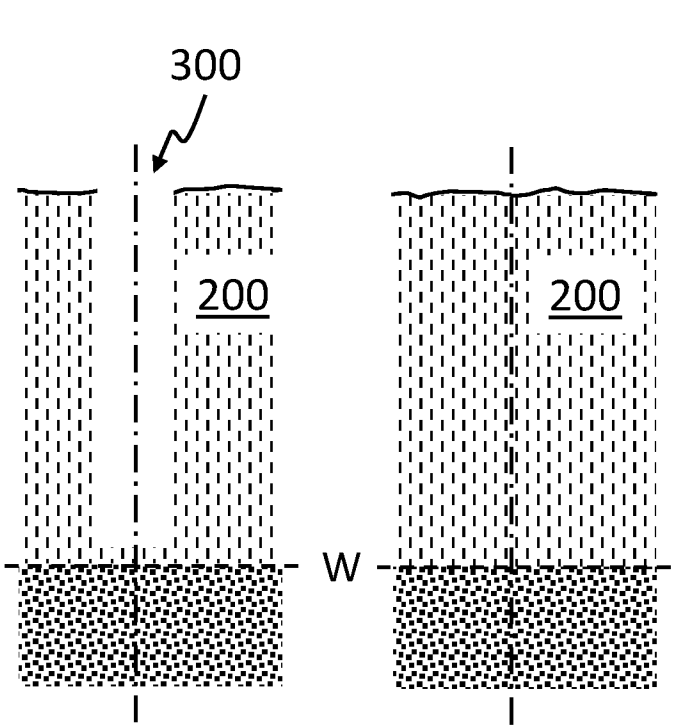
FIG. 3C
FIG. 3B
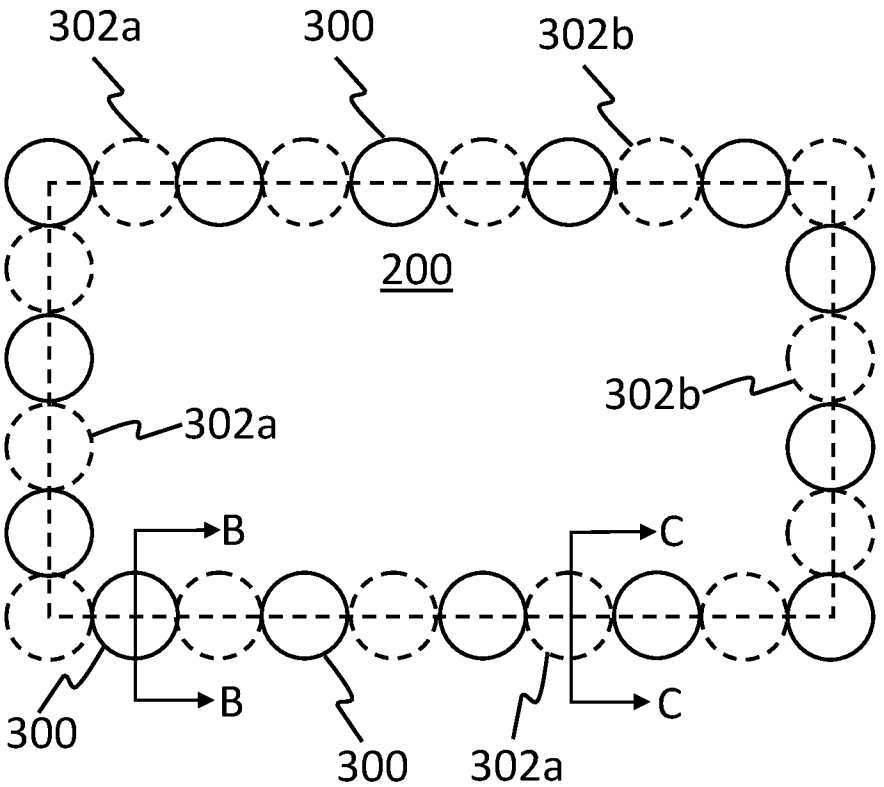
FIG. 3A

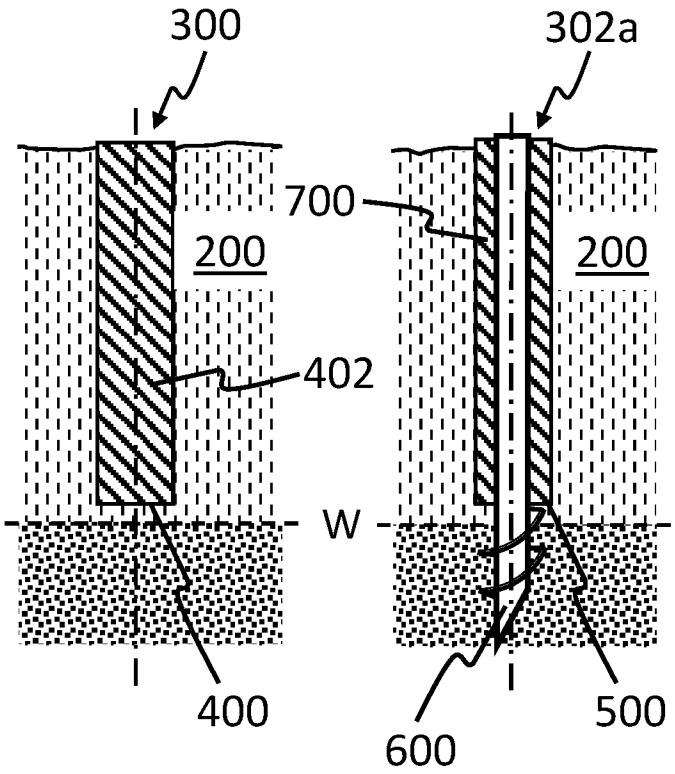
FIG. 7C
FIG. 7B
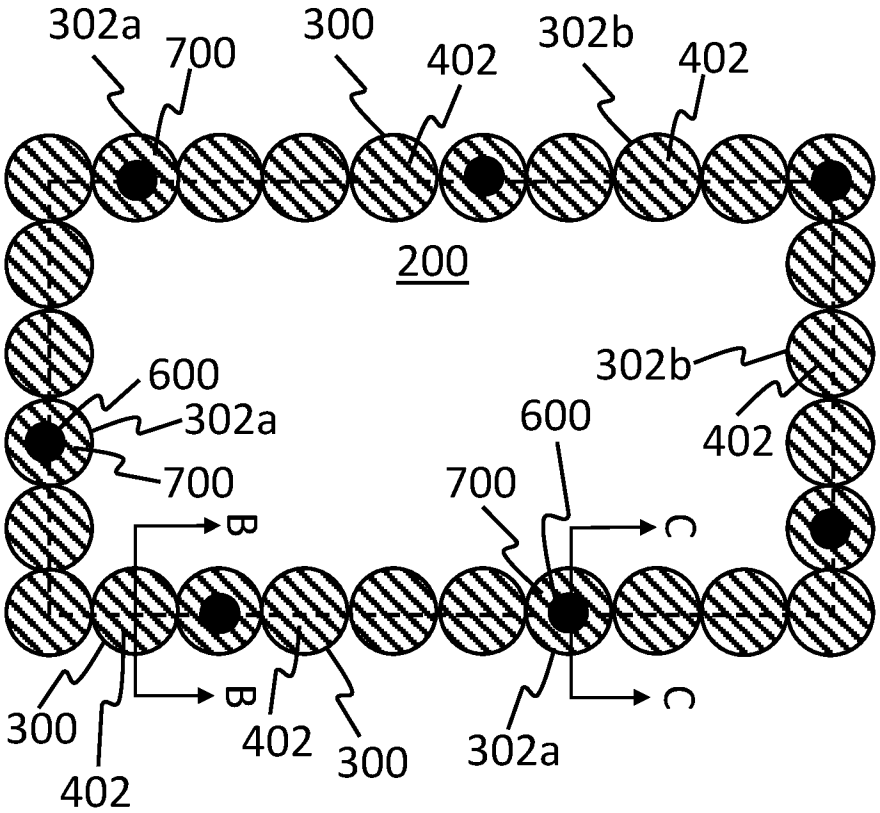
FIG. 7A

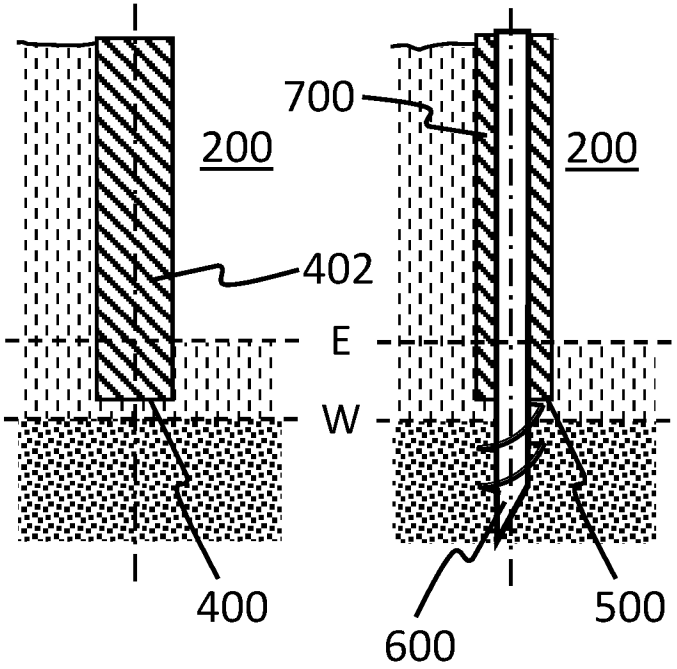
FIG. 8C
FIG. 8B
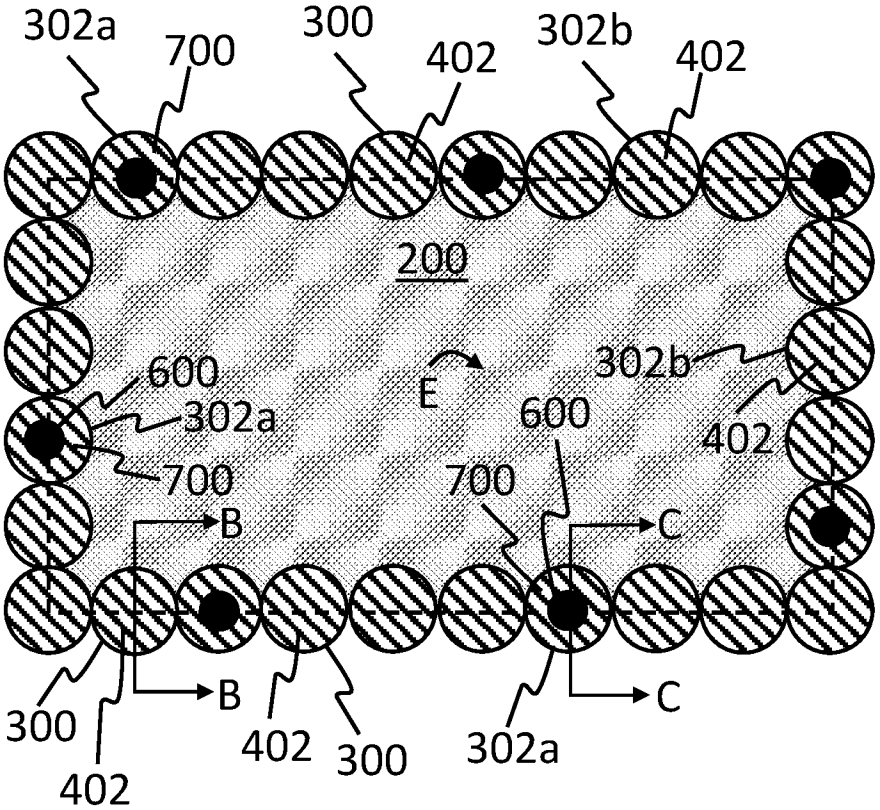
FIG. 8A

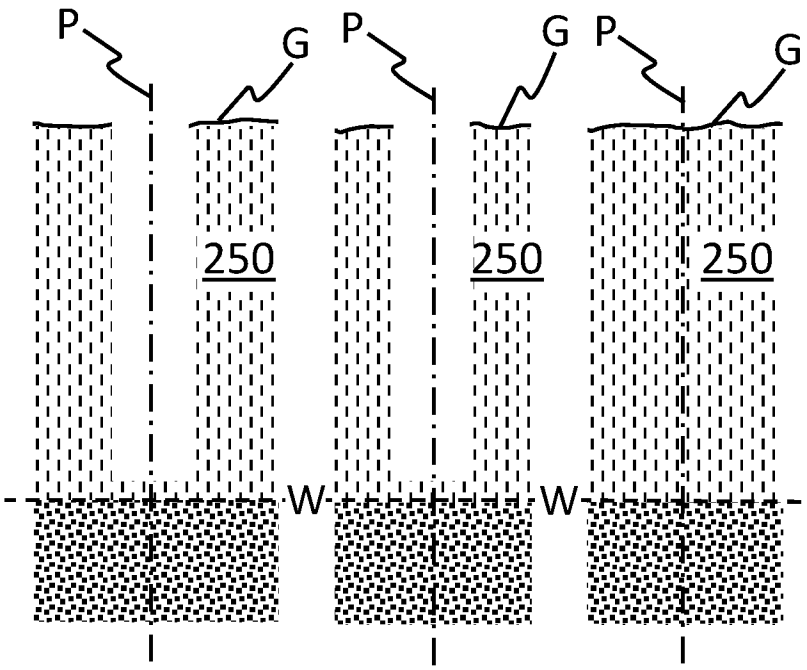
FIG. 10B
FIG. 10C
FIG. 10D
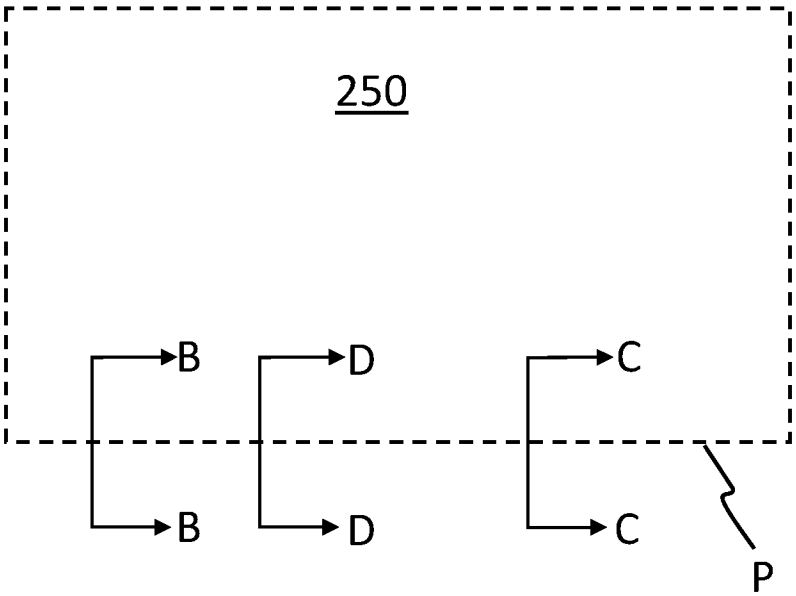
FIG. 10A

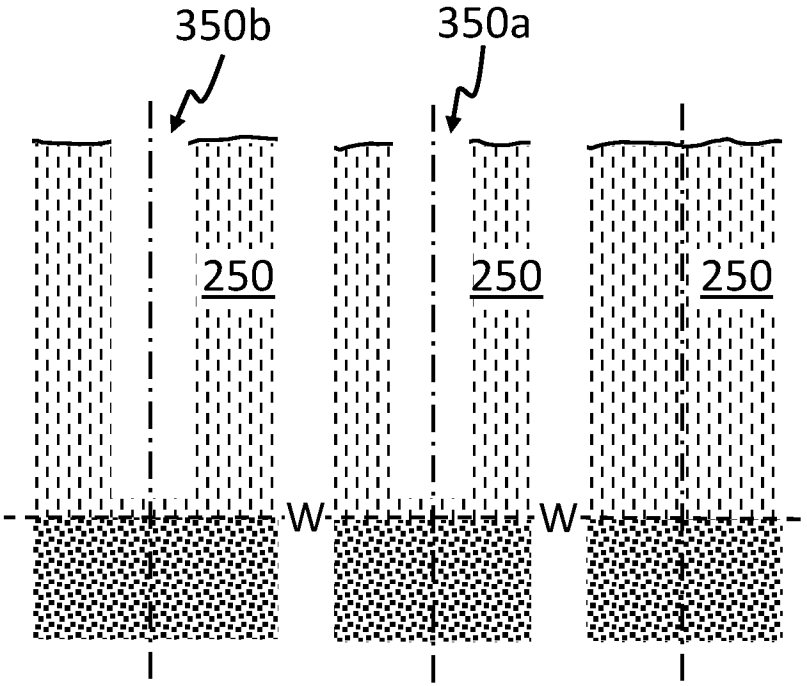
FIG. 10C
FIG. 11D
FIG. 11B
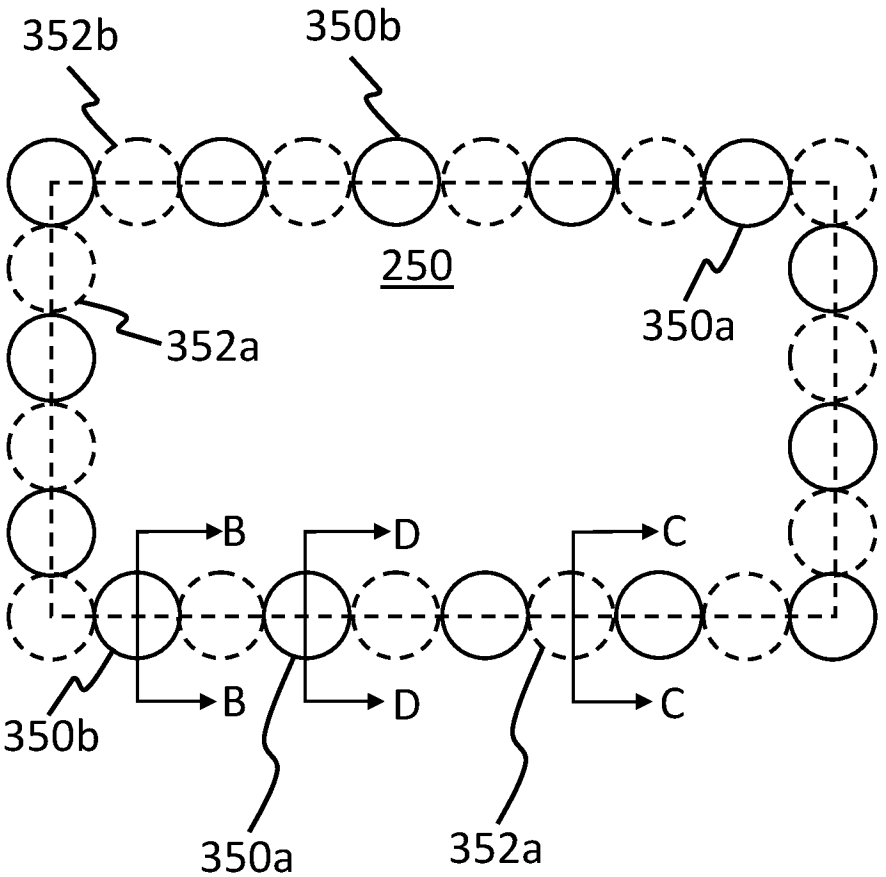
FIG. 11A

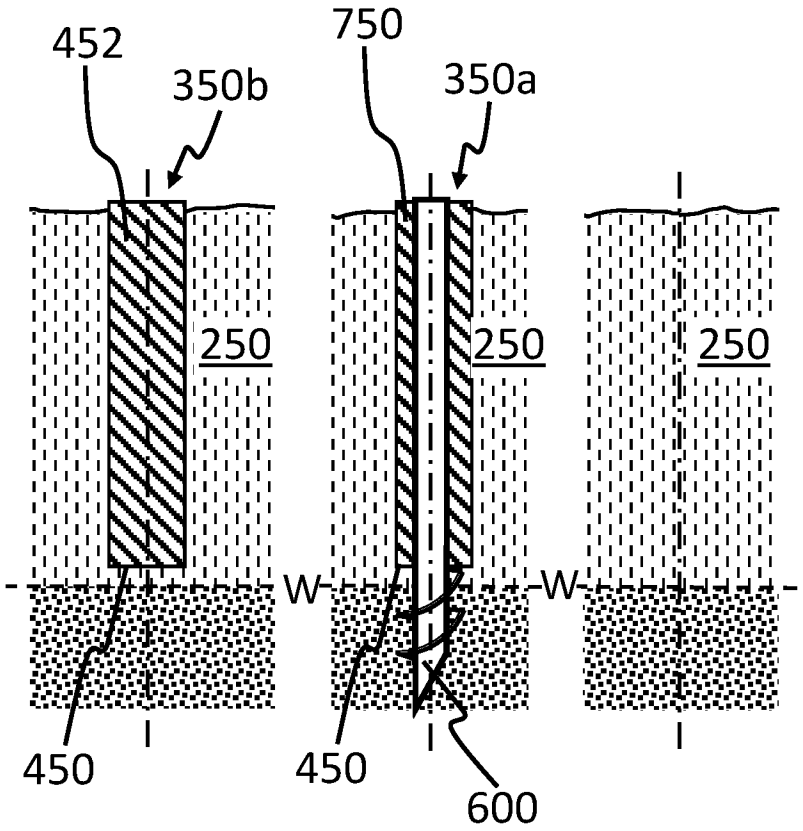
FIG. 13C
FIG. 13D
FIG. 13B
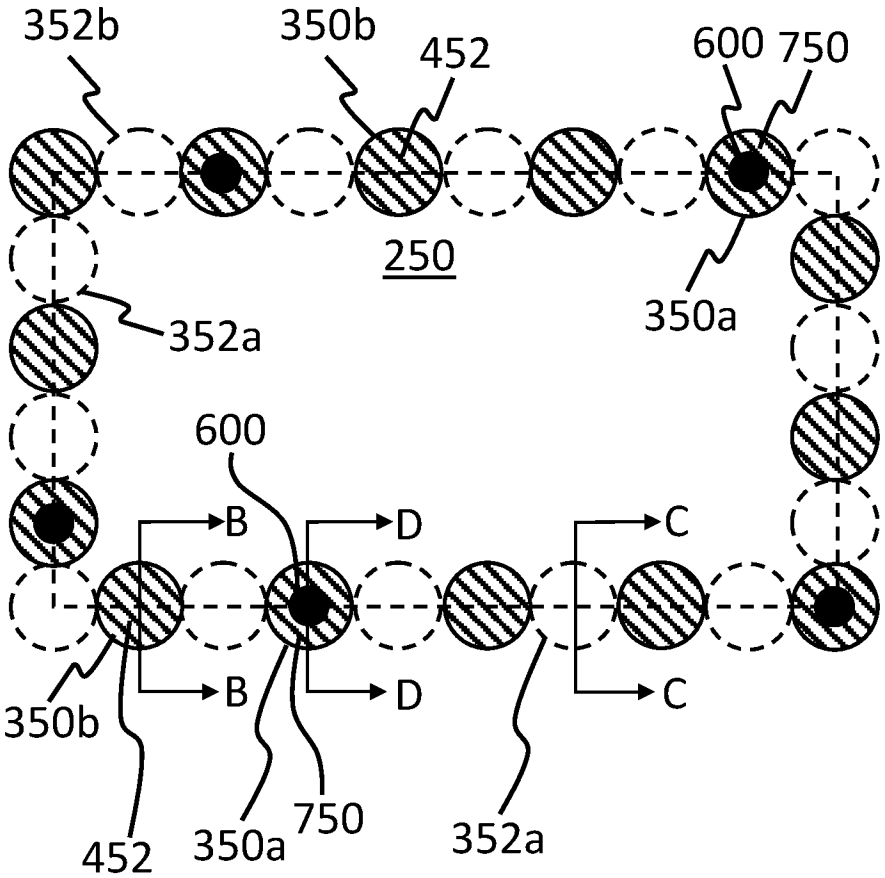
FIG. 13A

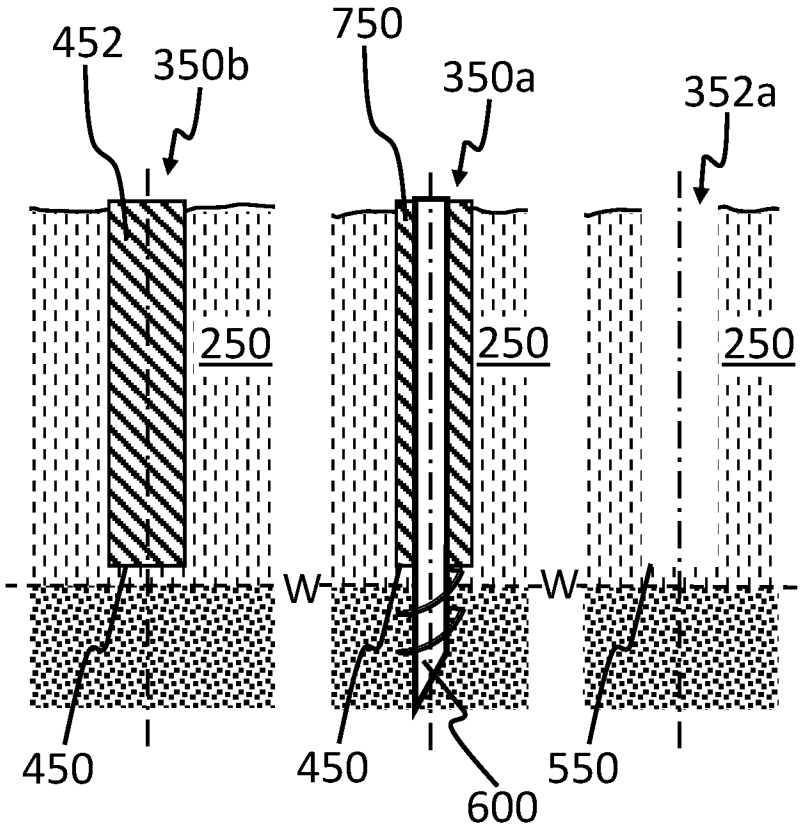
FIG. 14C
FIG. 14D
FIG. 14B
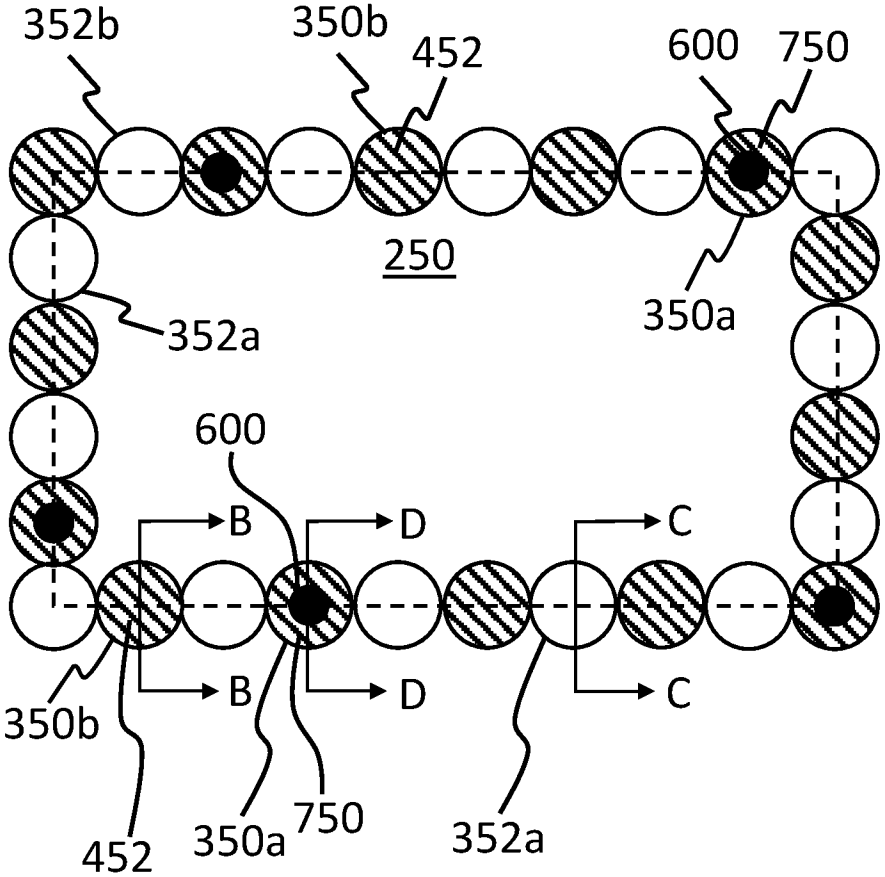
FIG. 14A

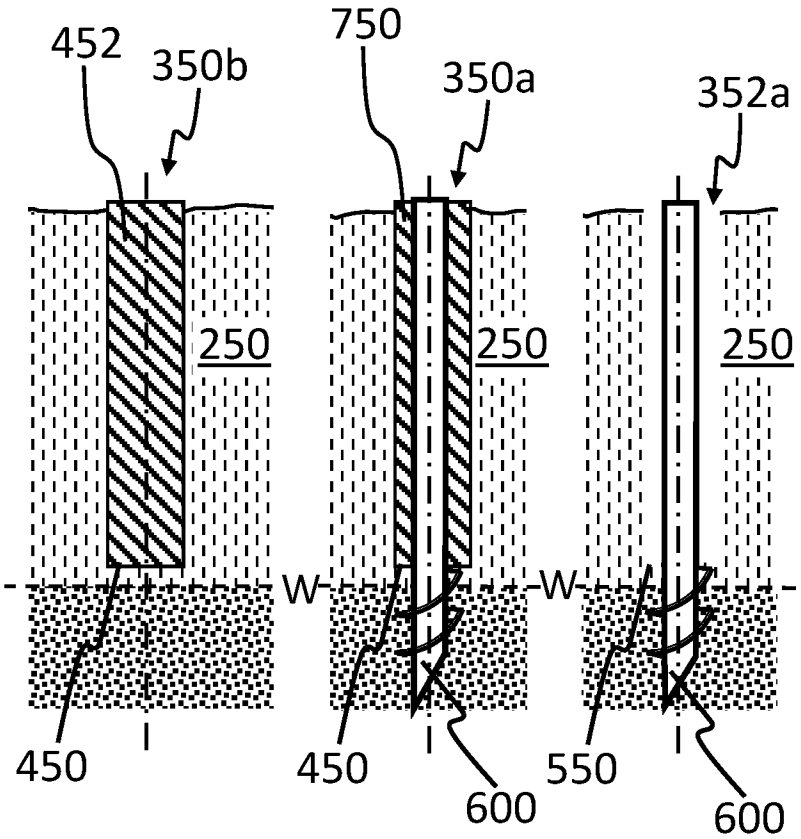
FIG. 15C
FIG. 15D
FIG. 15B
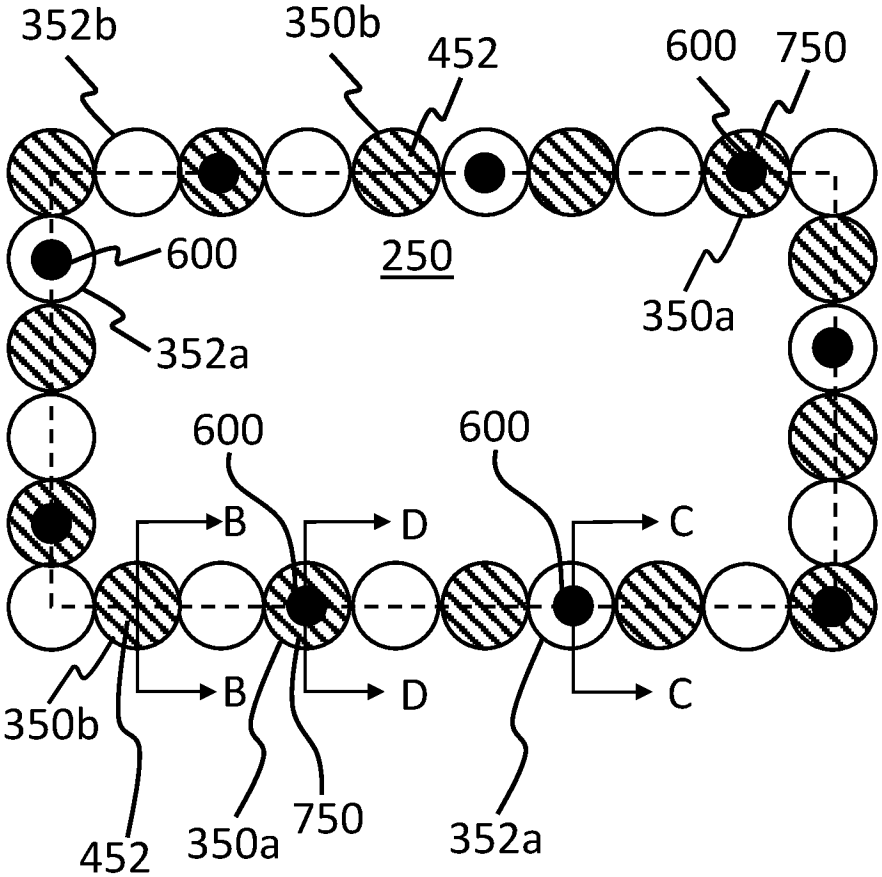
FIG. 15A

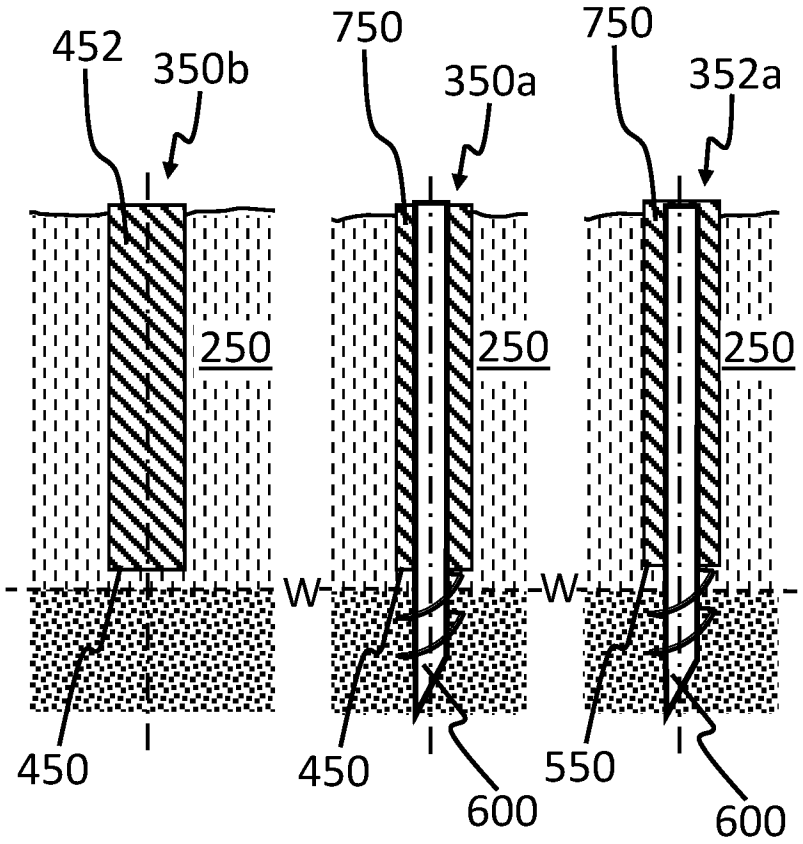
FIG. 16C
FIG. 16D
FIG. 16B
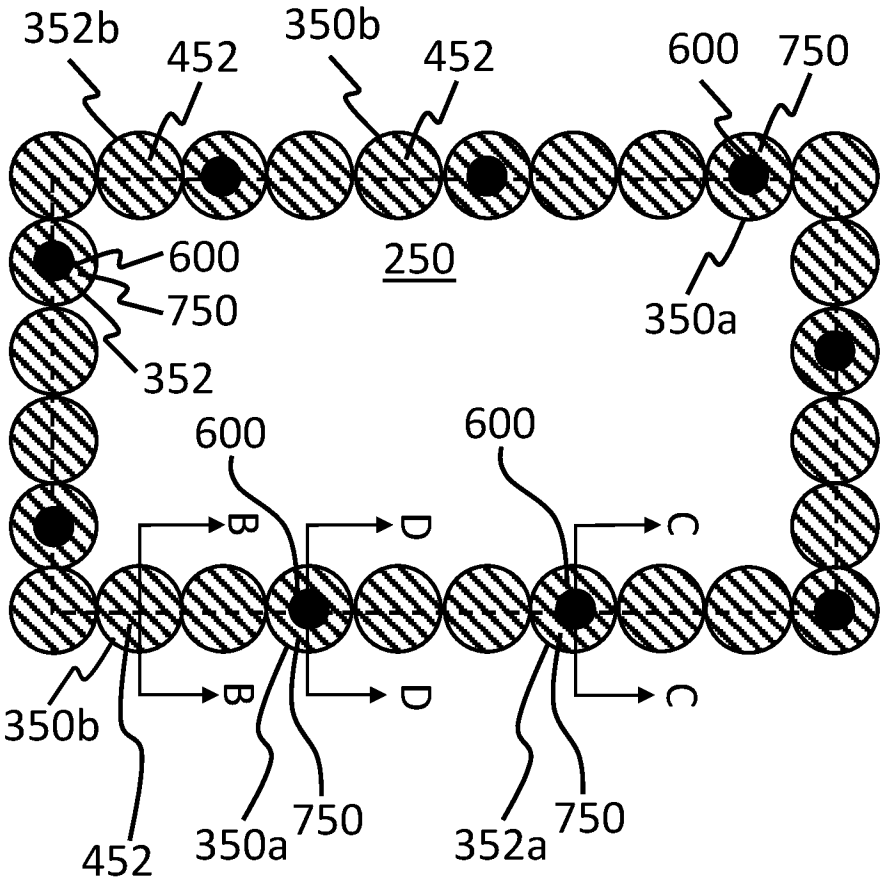
FIG. 16A

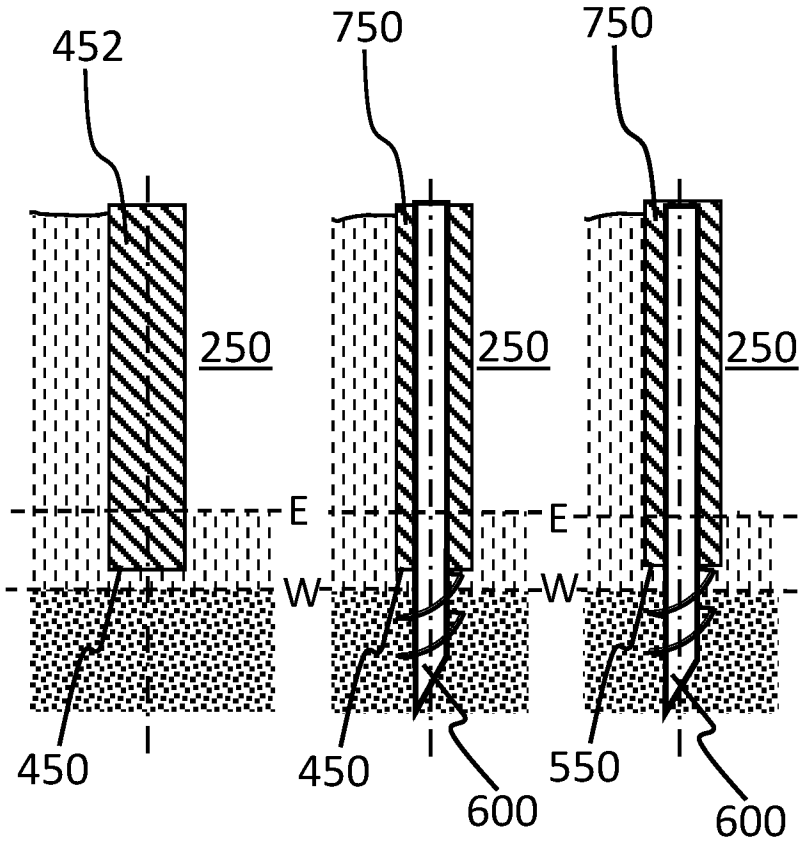
FIG. 17C
FIG. 17D
FIG. 17B
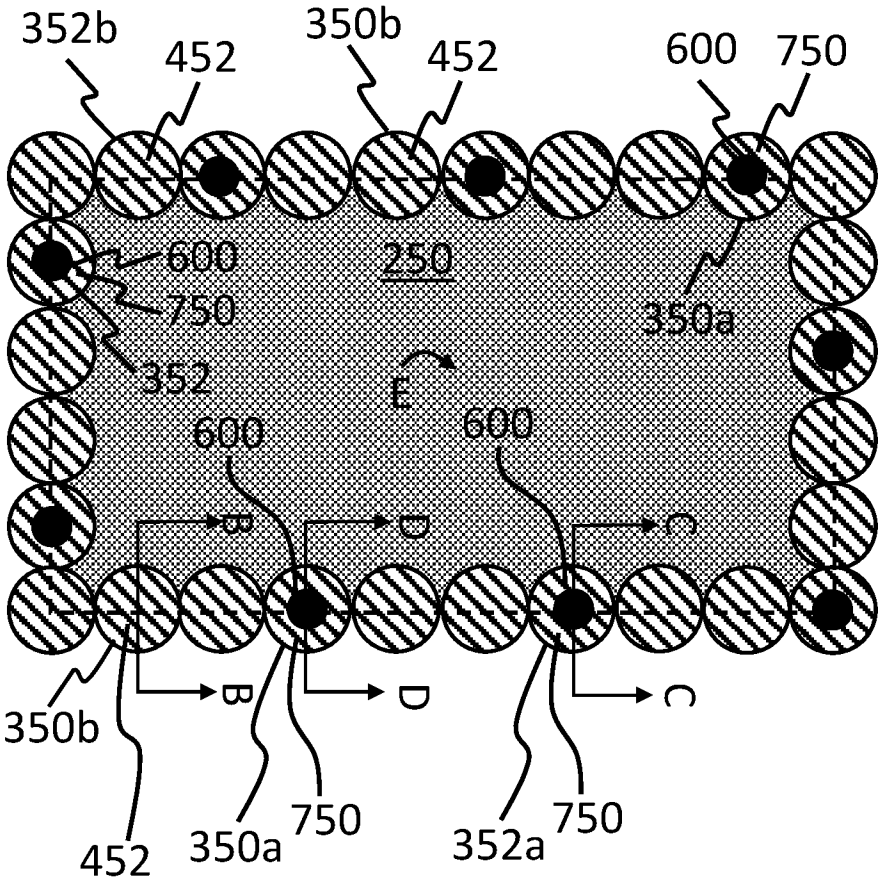
FIG. 17A

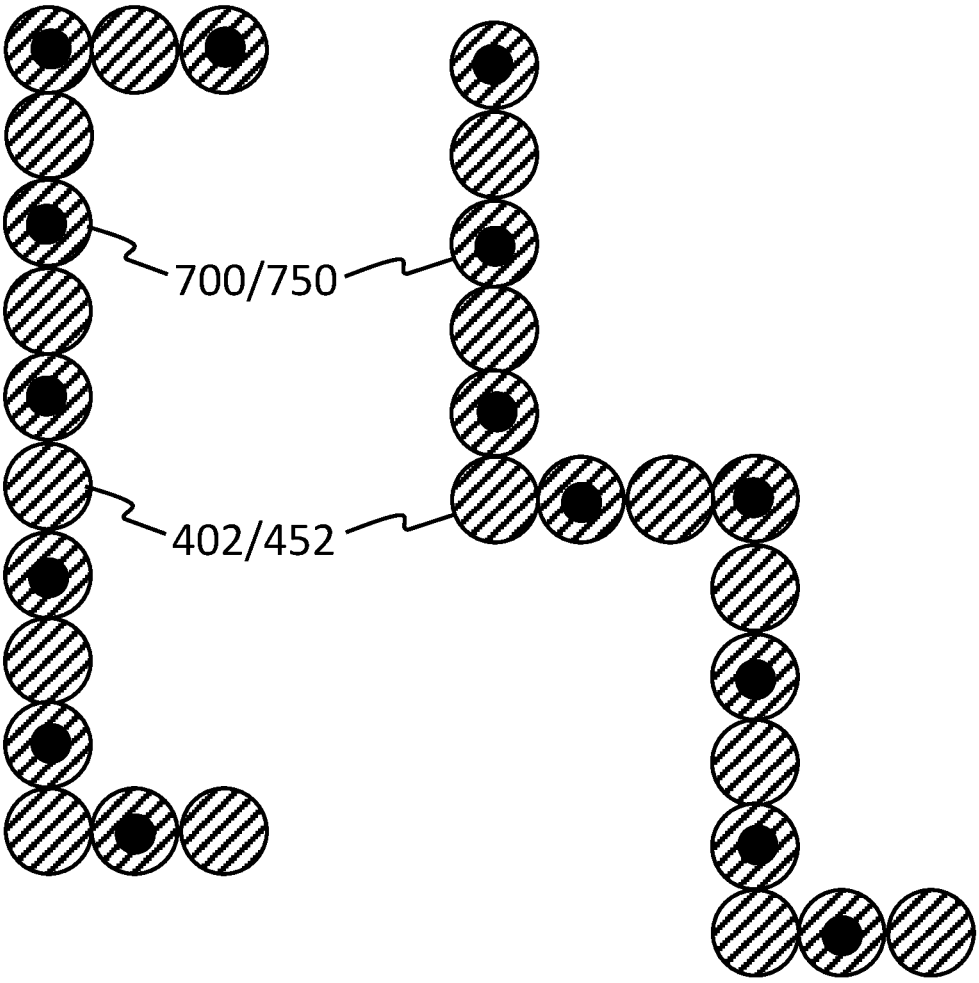
Fig. 18A
Fig. 18B
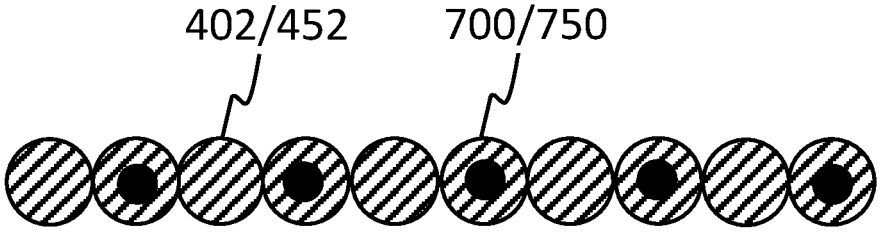
Fig. 18C

SECANT CONCRETE SHORING USING HELICAL PILES FOR DEPTH

FIELD

The present invention relates to pile systems and methods and more particularly to a pile wall system and method for constructing shoring walls using at least two types of piles.

BACKGROUND

Piles are a common feature of modern construction techniques and are often used in footings, retaining walls, underground fluid flow barriers, or for supporting a structure above the surface of the ground. Piles can be fabricated in many sizes and shapes and can be made of many different materials, most commonly steel, wood, or concrete. Wood or concrete piles most commonly take the shape of a solid rectangle or cylinder, while steel piles most commonly are manufactured in the form of a hollow cylinder. However, generally planar sheet piles made of steel, concrete, or plastic are also known and are used to some extent.

During use, piles normally extend at least partly into the ground. Numerous techniques may be used to bury the pile in the ground. One such technique is to excavate a hole using conventional techniques, place the pile into the hole, and then backfill the hole to secure the pile in place. A more common technique is to drive the pile into the earth by applying an impact force to the upper end of the pile.

Excavation projects that involve a deep excavation, typically between about 1.2 m to 10 m below ground level, require a shoring wall to hold back the ground material surrounding the excavation site and to prevent damage occurring to adjacent structures. When building a shoring wall, an array of concrete piles may be used and are less expensive than building a wall using steel piles. One common technique relies on boring a hole in the ground, removing the soil from the hole, and filling the hole with concrete to form a pile in situ. Two distinct types of pile shoring walls are known, each having unique advantages and disadvantages.

Tangent walls are characterized by a series of concrete piles that are touching or nearly touching. Typically, a sacrificial guide wall is constructed at ground level to act as a template for forming the bore holes. Supports, in the form of rods or rebar cages, are placed into each completed bore hole either prior to or shortly after pouring concrete. The supports strengthen the concrete piles and prevent them from moving during subsequent excavation of the site. These added supports are particularly important in a cantilevered shoring wall, in which the pile is formed in a bore hole that has been dug below the level of excavation. The unexcavated material in front of the pile provides the resistance needed to hold back the surrounding ground material and the supports add rigidity to the exposed portion of the piles above the level of excavation. Tangent walls are well suited for use in urban areas and on constrained sites, in which the excavation pit may extend to the property line and therefore traditional retaining methods would encroach the adjoining properties. However, tangent walls cannot be used in high ground water areas due to the difficulty of forming bore holes of sufficient depth in water-saturated ground material. In addition, water can pass through the space between adjacent piles unless the spaces are grouted.

Secant walls are similar to tangent walls but are characteristically stiffer and more watertight due to the use of primary concrete piles that are overlapped by reinforced secondary piles. The primary piles are formed first, such as for instance by digging a bore hole to a desired depth and then filling the bore hole with relatively soft concrete. After the primary piles have been allowed to harden sufficiently, the secondary piles are formed by drilling through the foundation soil and partly through the adjacent primary piles. Supports, in the form of rods or rebar cages, are placed into each secondary pile bore hole either prior to or shortly after pouring the concrete, which is relatively harder than the concrete used for the primary piles. The secondary piles overlap with the primary piles, which do not have an internal reinforcing support structure, and thereby prevent the primary piles from moving during subsequent excavation of the site.

Another type of pile used in modern construction techniques is the helical pile, which typically comprises a hollow shaft having an angled pilot poin and helical flights arranged along the bottom portion of the shaft. Helical piles are used in applications including structural support (compression or tension) for both permanent and temporary structures and for underpinning existing foundations. One advantage of helical piles is that they do not require the digging of an open bore hole. Instead, the pile is rotated about its longitudinal axis such that the helical flights penetrate into the soil and advance the pile directly into the earth without augering. Helical piles are typially installed using standard tracked or wheeled excavators with a torque motor attachment, which monitors the torque achieved during installation to verify the design.

Of course, the relatively small diameter of the helical pile shaft is not well suited for holding back ground material surrounding an excavation site, particularly in the case of a deep excavation site with a fine and/or loose soil structure. Accordingly helical piles alone cannot be used to form a reliable shoring wall. On the other hand, in some instances constructing a shoring wall in the ground solely using concrete piles is problematic. For instance, tangent walls cannot be constructed in high ground water areas due to the difficulty of forming the bore holes to a sufficient depth in the water-saturated ground material. If the shoring wall is to be reliable and safe for excavating a region within an area that is enclosed by poured concrete piles, then constructing a support wall in these conditions requires different measures.

The need thus exists for improved pile systems and more specifically to improved piles and systems and methods for forming piles in situ to form an excavation shoring wall.

SUMMARY

In accordance with an aspect of at least one embodiment, there is provided a pile shoring wall formed in the ground and comprising tangent concrete piles, the tangent concrete piles comprising: a first plurality of concrete piles in the ground at depths wherein the average depth is $d_1$; and a second plurality of concrete piles which includes 10% and less than 50% of the tangent concrete piles and having a shaft of a helical pile secured therewithin, wherein each helical pile has a bottom portion having helical flights for screwing the helical pile into the ground, wherein each helical pile is set into the ground to a depth of at least about 2 m below $d_1$, and wherein the helical flights of each helical pile is exposed to the soil around it.

In accordance with an aspect of at least one embodiment, there is provided a pile shoring wall comprising an array of concrete piles formed in the ground at depths, wherein the average depth is $d_1$, and arranged such that each concrete pile is substantially tangent to two adjacent concrete piles, wherein between 10% and 50% of the concrete piles are cast around a shaft of a helical pile, wherein each helical pile has a set of helical flights set into the ground below the concrete pile, and wherein a toe of each helical pile is at a depth of at least 2 m below $d_1$.

In accordance with an aspect of at least one embodiment, there is provided a method of constructing a pile shoring wall, comprising: forming a plurality of tangent concrete piles in the ground and along an edge of an area that is to be excavated to an excavation depth, comprising: forming a plurality of first concrete piles in the ground at depths wherein the average depth is $d_1$; and forming a plurality of second concrete piles which includes 10% and less than 50% of the tangent concrete piles, wherein forming each second concrete pile comprises: forming a bore hole in the ground, the bore hole having a bottom at a depth below ground surface level that is deeper than the excavation depth; installing a helical pile into ground material below the bottom of the bore hole, such that a shaft of the helical pile protrudes upwardly from the ground material and into the bore hole; and at least partially filling the bore hole with concrete such that the concrete fills around the protruding shaft of the helical pile and forms a column of concrete defining one of the second concrete piles.

BRIEF DESCRIPTION OF THE DRAWINGS

The instant disclosure will now be described by way of example only, and with reference to the attached drawings, which are not drawn to scale and are intended to be illustrative only, and in which:

FIGS. 2A-2C show a plan view and cross-sectional views of a first excavation site prior to being excavated.

FIGS. 3A-3C show a plan view and cross-sectional views of the first excavation site after digging a first plurality of bore holes.

FIGS. 7A-7C show a plan view and cross-sectional views of the first excavation site after filling the second plurality of bore holes with concrete to form a completed shoring wall.

FIGS. 8A-8C show a plan view and cross-sectional views of the first excavation site after excavating the area bounded by the completed shoring wall.

FIGS. 10A-10D show a plan view and cross-sectional views of a second excavation site prior to being excavated.

FIGS. 11A-11D show a plan view and cross-sectional views of the first excavation site after digging a first plurality of bore holes.

FIGS. 13A-13D show a plan view and cross-sectional views of the first excavation site after filling the first plurality of bore holes with concrete.

FIGS. 14A-14D show a plan view and cross-sectional views of the first excavation site after digging a second plurality of bore holes in an alternating sequence with the first plurality of bore holes.

FIGS. 15A-15D show a plan view and cross-sectional views of the first excavation site after installing helical piles in some of the second plurality of bore holes.

FIGS. 16A-16D show a plan view and cross-sectional views of the first excavation site after filling the second plurality of bore holes with concrete to form a completed shoring wall.

FIGS. 17A-17D show a plan view and cross-sectional views of the first excavation site after excavating the area bounded by the completed shoring wall.

FIGS. 18A-18C show non-limiting examples of different shoring wall configurations that do not fully enclose an excavation site.

DETAILED DESCRIPTION

While the present teachings are described in conjunction with various embodiments and examples, it is not intended that the present teachings be limited to such embodiments. On the contrary, the present teachings encompass various alternatives and equivalents, as will be appreciated by those of skill in the art. All statements herein reciting principles, aspects, and embodiments of this disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

As used herein, the terms "first," "second," and so forth are not intended to imply sequential ordering, but rather are intended to distinguish one element from another, unless explicitly stated. Similarly, sequential ordering of method steps does not imply a sequential order of their execution, unless explicitly stated.

As used herein, the term "tangent" is defined as touching or nearly touching but not intersecting. "Tangent concrete piles" and similar terms are used to indicate an arrangement in which the outside surfaces of adjacent concrete piles touch or nearly touch but do not intersect. Concrete piles that nearly touch may have a space of about 2.5 cm or less therebetween, preferably 1.5 cm or less therebetween, and more preferably 1 cm or less therebetween. In a constructed shoring wall according to an embodiment, some pairs of adjacent concrete piles may touch one another whilst other pairs of adjacent concrete piles may nearly touch one another. Further, a minor portion (e.g., <15%, preferably <10% and more preferably <5%) of the concrete piles may be spaced from one or both adjacent concrete piles, along at least a portion of a length thereof, by a distance that is greater than 2.5 cm, e.g., due to imprecise bore hole drilling and/or inadvertent formation of void spaces when the bore holes are being filled with concrete, without departing from the scope of the invention.

Figure 1:
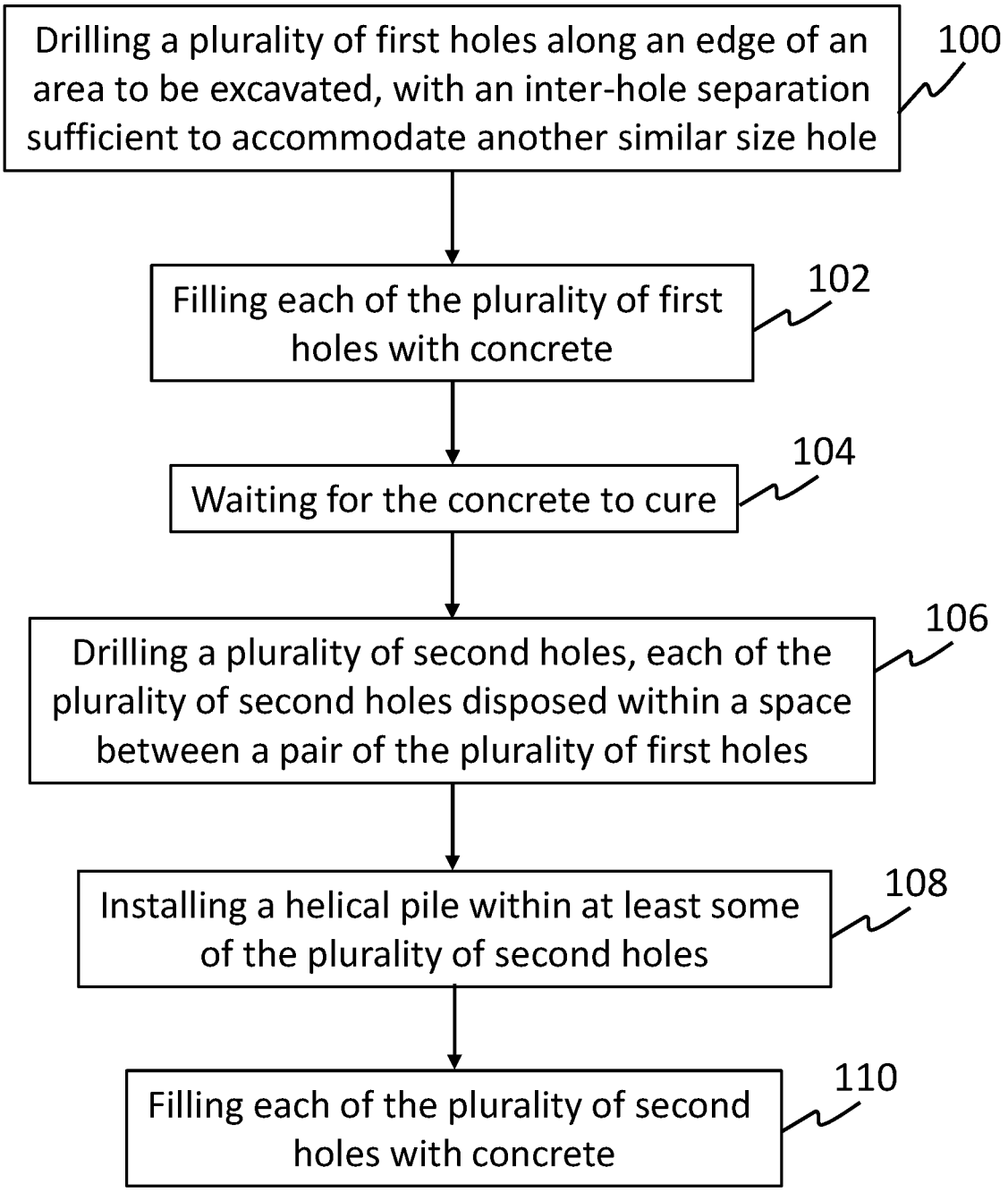
FIG. 1 is a simplified flow diagram for a method of forming a shoring wall according to an embodiment.

Referring now to FIG. 1, shown is a simplified flow diagram of a method of forming a shoring wall according to an embodiment. The method may be used in a variety of situations involving a deep excavation, including excavation projects in constrained sites, excavation projects that extend close to a property line, and/or excavation projects that are adjacent to an existing structure, etc. In addition, the method may be used in areas in which the water table is too high to permit the use of traditional tangent or secant walls.

A shoring wall constructed according to the method of FIG. 1 includes two types of tangent concrete piles, in particular i) a first type of concrete pile that does not have a shaft of a helical pile embedded therewithin, and ii) a second type of concrete pile, which is between about 10% and about 50% of the total number of tangent concrete piles, and which has a shaft of a helical pile embedded therewithin. The helical pile is set into ground material below the second concrete piles, thereby increasing resistance when the site is excavated on one side of the shoring wall.

By way of some specific and non-limiting examples, each one of the first type of concrete piles and each one of the second type of concrete piles may have an outside diameter between about 18 cm and about 36 cm, preferably between about 24 cm and about 30 cm. The length (measured vertically) or the depth to which each of the concrete piles is formed depends on the nature of the excavation that is being performed as well as the ground conditions at the excavation site. For instance, each one of the first type of concrete piles and each one of the second type of concrete piles may be formed in a bore hole having a bottom that is at least about 1 m below the planned excavation level and at least about 1 m to about 1.5 m above the water table height. In addition, each helical pile may be set into the ground and exposed to the surrounding soil to a depth of about 2 m to about 3 m. Each helical pile may have a shaft that extends upwardly from the bottom of the bore hole by about 3.5 m to about 6 m. Other dimensions may be used, depending on the soil conditions and other requirements of a particular project.

At step 100, a plurality of substantially vertical first bore holes are formed in the ground and extending to a depth that is below the planned excavation depth. The first bore holes are formed along an edge of an area that is to be excavated. More particularly, the first bore holes are spaced apart one from another by a distance that can accommodate another similar sized bore hole therebetween in a touching or near touching relationship therewith. Preferably, a sacrificial guide wall is constructed at ground level and used to ensure that the first bore holes are formed with the correct spacing therebetween.

At step 102 each of the first bore holes is filled with concrete, either to approximately the ground surface level or to another predetermined level above or below the ground surface level. As will be apparent to one of ordinary skill in the art, suitable forms can be used to extend the level of the concrete above the ground surface level. Known techniques may be used to fill the first bore holes, such as for instance pouring the concrete into the first bore holes or pumping the concrete through a hose to the base of the bore holes.

The concrete in the first bore holes is then allowed to cure at step 104. After curing, the hardened concrete in each of the first bore holes forms one concrete pile of the first type of concrete piles of the shoring wall, i.e., a concrete pile without a shaft of a helical pile embedded therein. Preferably, the concrete has a compressive strength of 5 MPa to 20 MPa.

At step 106 a plurality of second bore holes is formed, such that one second bore hole is disposed between each pair of previously formed first bore holes. Preferably, the sacrificial guide wall is used to ensure proper location of each of the second bore holes. The second bore holes may extend to substantially the same depth as the first bore holes, or the second bore holes may be deeper or shallower than the first bore holes. For simplicity, it is assumed that the first bore holes and second bore holes are formed to an average depth $d_1$, and it is further assumed that any variation of the depth of individual bore holes from the average depth $d_1$ is not relevant to the principles discussed herein.

Referring now to step 108, a helical pile is installed within at least some of the plurality of second bore holes. The helical piles may be installed using a standard tracked or wheeled excavator with a torque motor attachment, which monitors the torque achieved during installation to verify the design. Generally, the helical pile comprises a hollow tubular shaft fabricated from steel or another suitable material. A lower portion of the shaft has helical flights that are designed to pull the helical pile into the ground material, without augering, when the helical pile is rotated about a longitudinal axis along the length of the shaft. As such, the ground material remains substantially in place and is not pulled up into the bore hole when the helical pile is being installed. The lower portion of the shaft is open and terminates in an angled pilot point, which assists in advancing the helical pile into the ground during rotation. Ground material fills the interior of the shaft as the helical pile advances. The upper portion of the shaft remains protruding out of the ground material at the bottom of the bore hole after the helical pile has been installed. Preferably, the upper portion of the shaft includes features that increase contact between the helical pile and the concrete when the bore hole is filled. For instance, the shaft may have a plurality of through holes between the interior and exterior of the shaft. Further, the shaft may have a textured outer surface, or the shaft may have features such as rods or plates that extend away from the shaft and become embedded in the concrete when the bore hole is filled.

At step 110 the second bore holes are filled with concrete, either to approximately the ground surface level or to another predetermined level. Suitable forms can be used to extend the level of the concrete above the ground surface level. Known techniques may be used to fill the bore holes, such as for instance pouring the concrete or pumping the concrete through a hose to the base of the bore holes.

After curing, the hardened concrete in each second bore hole that has a shaft of a helical pile therewithin forms one concrete pile of the second type of concrete piles. On the other hand, after curing, the hardened concrete in each second bore hole that does not have a shaft of a helical pile therewithin, if any, forms one concrete pile of the first type of concrete piles. Preferably, the concrete that is used to form the second concrete piles has a compressive strength of 5 MPa to 20 MPa.

In combination, the concrete piles of the first type of concrete piles and the concrete piles of the second type of concrete piles form a tangent shoring wall in which the concrete piles are touching or nearly touching. The method that has been described with reference to FIG. 1 may be implemented with numerous modifications without departing from the scope of the instant invention. Several non-limiting examples of possible shoring wall configurations and helical pile placements are discussed below in more detail.

FIGS. 2A-2C through FIGS. 8A-8C illustrate the steps of the method shown in FIG. 1, using the example of a shoring wall having a generally rectangular footprint around an excavation area 200. With specific reference to FIG. 2A, shown is a plan view of an excavation site prior to the excavation area 200 being excavated. FIGS. 2B and 2C are cross-sectional views taken along the lines B-B and C-C in FIG. 2A, respectively. The dot-dash line "P" in FIGS. 2B and 2C corresponds to the plane "P" in FIG. 2A, which is aligned with the edge of the dashed line rectangle enclosing the excavation area 200. As shown in FIGS. 2B and 2C, the ground surface "G" is substantially level. The height of the water table in the excavation area 200 is denoted in FIGS. 2B and 2C by the dashed line "W."

Referring now to FIG. 3A, shown is a plan view of the excavation site with a template for forming first bore holes 300 and second bore holes 302*a* and 302*b* around the perimeter of a dashed line rectangle, which encloses the excavation area 200. As shown in FIG. 3B, the first bore holes (which are shown using solid lines in FIG. 3A) have been formed to a depth that is shallower than the water table height W but deeper than the required excavation depth (not indicated). As shown in FIG. 3C, the second bore holes 302*a* and 302*b* (which are shown using dashed lines in FIG. 3A) have not been formed. As will be apparent, a guide wall structure or other physical template built at the ground surface level facilitates planning and placement of the first bore holes 300 and the second bore holes 302*a* and 302*b*, such that the concrete piles formed therein are touching or nearly touching in the finished shoring wall.

Figure 4C:
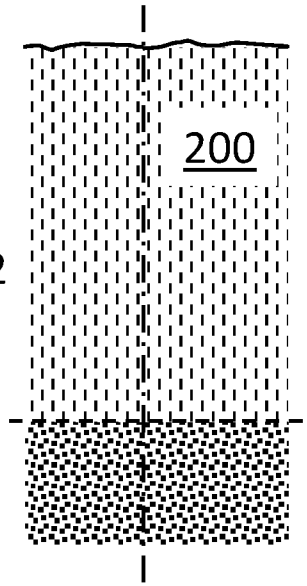
FIGS. 4A-4C show a plan view and cross-sectional views of the first excavation site after filling the first plurality of bore holes with concrete.
Figure 4B:
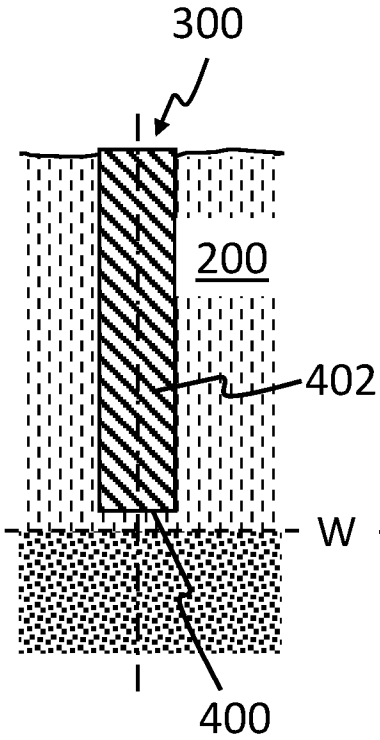
Figure 4A:
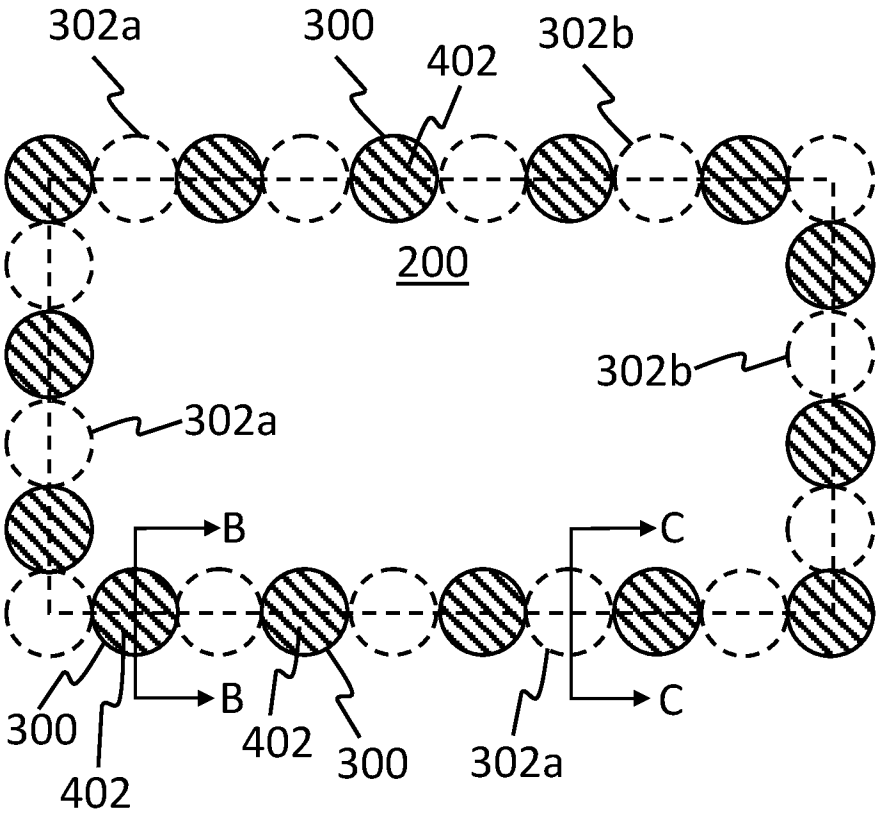

Referring now to FIG. 4A, shown is a plan view of the excavation site after the first bore holes 300 have been filled with concrete, as indicated by the diagonal fill lines in the drawings. As discussed with reference to step 102 of FIG. 1, the first bore holes 300 may be filled using any suitable technique, including pouring the concrete into the bore holes 300 or pumping the concrete to the bottom of the bore holes 300 using a hose. A suitable concrete mixture may be selected by one of ordinary skill in the art to achieve a final cured concrete pile having desired properties. Preferably, the concrete that is used to fill the bore holes 300 has a compressive strength of 5 MPa to 20 MPa. As shown in FIG. 4B, the bore hole 300 may be filled between the bottom 400 thereof to approximately the ground surface level G. Optionally, the bore hole 300 is filled to a level that is below the ground surface level G. Further optionally, forms are placed above ground surface level G to extend the concrete above ground surface level G. As discussed with reference to step 104 of FIG. 1, the concrete in each of first bore holes 300 hardens to define a corresponding concrete pile 402 of the first type of concrete piles.

Figure 5C:
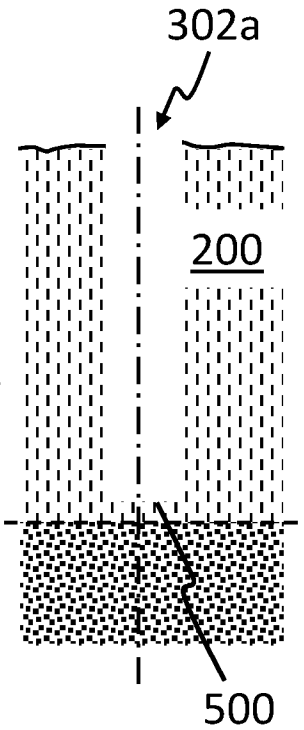
FIGS. 5A-5C show a plan view and cross-sectional views of the first excavation site after digging a second plurality of bore holes in an alternating sequence with the first plurality of bore holes.
Figure 5B:
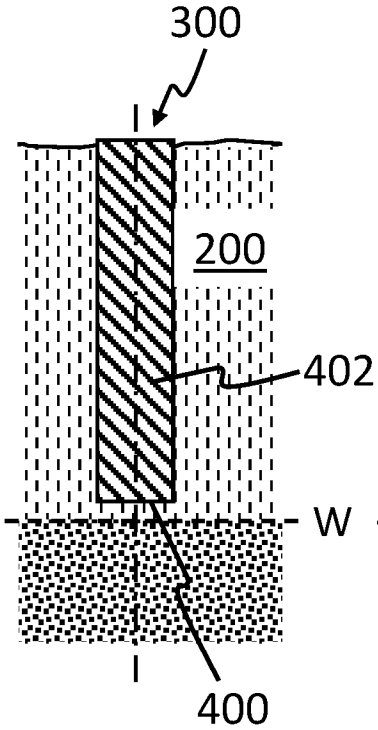
Figure 5A:
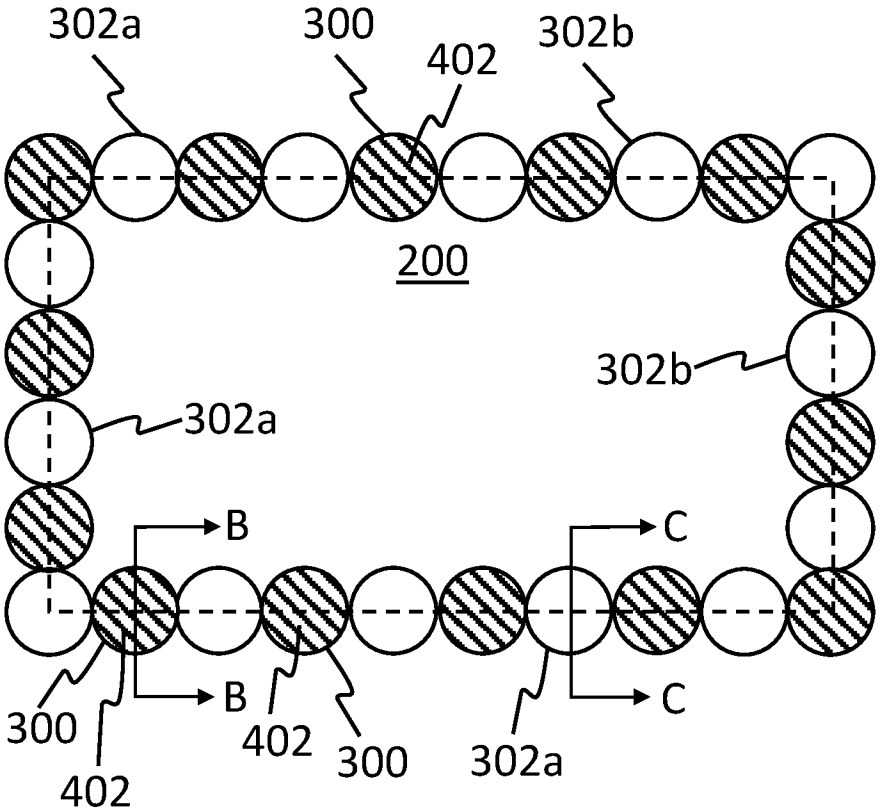

Referring now to FIG. 5A, shown is a plan view of the excavation site after the second bore holes 302*a* and 302*b* have been formed, as indicated by using solid lines instead of dashed lines. As shown in FIGS. 5B and 5C, the second bore hole 302*a* is formed to a depth that is similar to the depth of the first bore hole 300, such that the bottom 500 of the second bore hole 302*a* is approximately at the same depth below ground surface level G as the bottom 400 of the first bore hole 300 (i.e., the above-mentioned average depth $d_1$). As shown in FIG. 5A the perimeter of each second bore hole 302*a* and 302*b* is tangent to, i.e., touching or nearly touching, the perimeter of two adjacent first bore holes 300. The bore holes 302*a* and 302*b* are substantially identical to one another.

Figure 6C:
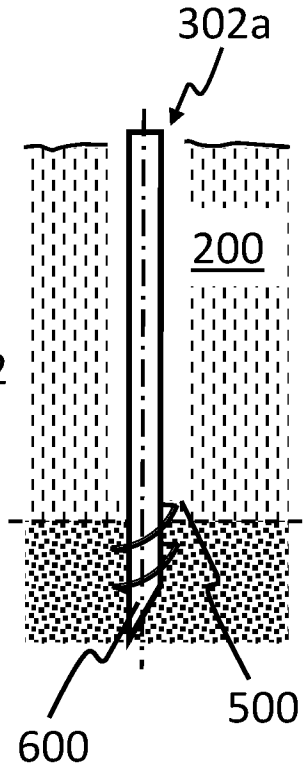
FIGS. 6A-6C show a plan view and cross-sectional views of the first excavation site after installing helical piles in some of the second plurality of bore holes.
Figure 6B:
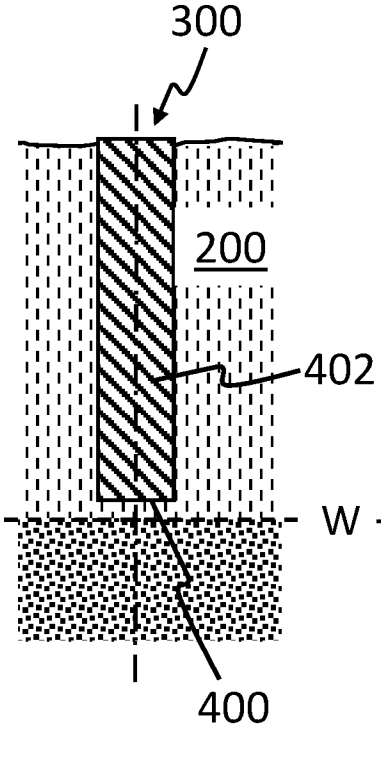
Figure 6A:
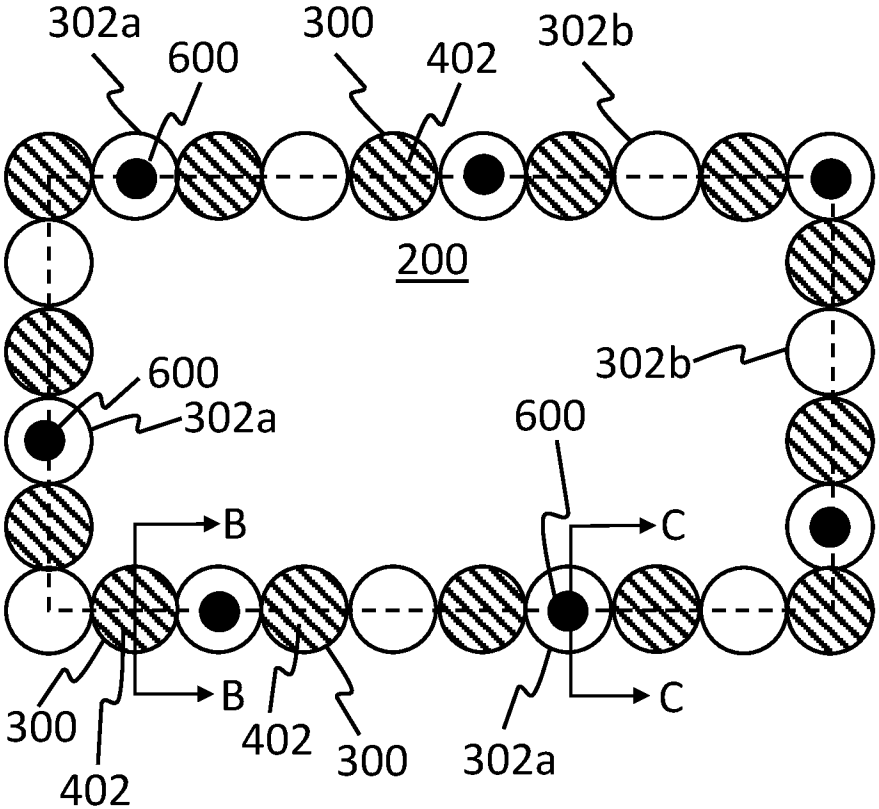

Referring now to FIG. 6A, shown is a plan view of the excavation site after helical piles 600 have been installed within the second bore holes 302*a*, but not within the second bore holes 302*b*. As shown in FIG. 6C, the helical pile 600 is installed such that helical flights arranged along the lower portion of the shaft are embedded into the ground material below the bottom 500 of the second bore hole 302*a*. In this example, the lower portion of the installed helical pile 600 is disposed below the water table level W. Advantageously, the helical pile 600 is installed by rotating the shaft thereof so as to cause the helical flights to advance into the ground material below the bottom 500 of the second bore hole 302*a*.

Referring now to FIG. 7A, shown is a plan view of the excavation site after the second bore holes 302*a* and 302*b* have been filled with concrete, as indicated by the diagonal fill lines in the drawings. As discussed with reference to step 110 of FIG. 1, the second bore holes 302*a* and 302*b* may be filled using any suitable technique, including pouring the concrete into the bore holes 302*a* and 302*b* or pumping the concrete to the base of the bore holes 302*a* and 302*b* using a hose. A suitable concrete mixture may be selected by one of ordinary skill in the art to achieve a final cured concrete pile having desired properties. Preferably, the concrete that is used to fill the bore holes 302*a* and 302*b* has a compressive strength of 5 MPa to 20 MPa.

FIG. 7C shows that the bore hole 302*a* may be filled between the bottom 500 thereof to approximately the ground surface level G. Optionally, the bore hole 302*a* is filled to a level that is below the ground surface level G. Further optionally, forms are used above ground surface G to extend the concrete in the bore hole 302*a* above ground level. The bore holes 302*b* may be filled in a similar fashion.

After hardening, the concrete in each of second bore holes 302*a* having a shaft of a helical pile therewithin defines a corresponding concrete pile 700 of the second type of concrete piles. On the other hand, the hardened concrete within each second bore hole 302*b* that does not have a shaft of a helical pile therewithin forms a corresponding concrete pile 402 of the first type of concrete piles. In other words, the concrete piles 402 that are formed within the second bore holes 302*b* are substantially identical to the concrete piles 402 that are formed within the first bore holes 300.

Referring now to FIGS. 8A-8C, the use of helical piles 600 in the second bore holes 302*a* gives the finished shoring wall greater strength by increasing resistance below the excavation level "E." This increased resistance is achieved without forming the second bore holes 302*a* to a deeper depth, which in the instant example would require digging an open hole into water-saturated ground material below the water table level W. As will be apparent to one of ordinary skill in the art, digging an open hole into ground water containing soil is problematic since the soil tends to comprise fine or granular particles and is prone to collapsing into the bore hole.

Figure 9:
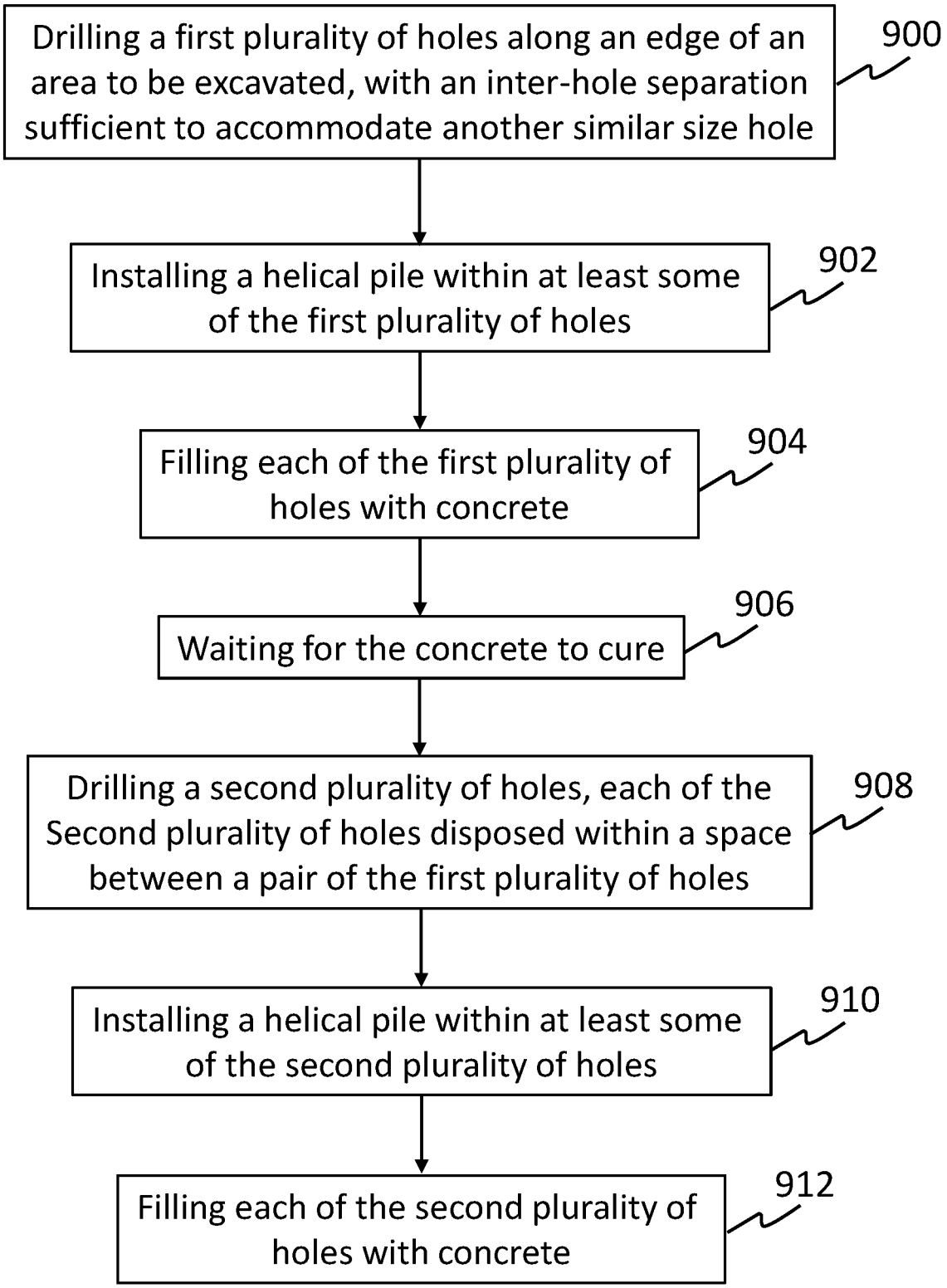
FIG. 9 is a simplified flow diagram for a method of forming a shoring wall according to an embodiment.

Referring now to FIG. 9, shown is a simplified flow diagram of another method of forming a shoring wall according to an embodiment. The method may be used in a variety of situations involving a deep excavation, including excavation projects in constrained sites, excavation projects that extend close to the property line, and/or excavation projects that are adjacent to existing structures, etc. In addition, the method may be used in areas in which the water table is too high to permit the use of traditional tangent or secant walls.

A shoring wall constructed according to the method of FIG. 9 includes two types of tangent concrete piles, in particular i) a first type of concrete pile that does not have a shaft of a helical pile embedded therewithin, and ii) a second type of concrete pile, which is between about 10% and about 50% of the total number of tangent concrete piles, and which has a shaft of a helical pile embedded therewithin. The helical pile is set into ground material below the second concrete piles, thereby increasing resistance when the site is excavated on one side of the shoring wall.

By way of some specific and non-limiting examples, each one of the first type of concrete piles and each one of the second type of concrete piles may have an outside diameter between about 18 cm and about 36 cm, preferably between about 24 cm and about 30 cm. The length (measured vertically) or the depth to which each of the concrete piles is formed depends on the nature of the excavation that is being performed as well as the ground conditions at the excavation site. For instance, each one of the first type of concrete piles and each one of the second type of concrete piles may be formed in a bore hole having a bottom that is at least about 1 m below the planned excavation level and at least about 1 m to about 1.5 m above the water table height. In addition, each helical pile may be set into the ground and exposed to the surrounding soil to a depth of about 2 m to about 3 m. Each helical pile may have a shaft that extends upwardly from the bottom of the bore hole by about 3.5 m to about 6 m. Other dimensions may be used, depending on the soil conditions and other requirements of a particular project.

At step 900, a plurality of substantially vertical first bore holes are formed in the ground and extending to a depth that is below the planned excavation depth. The first bore holes are formed along an edge of an area that is to be excavated. More particularly, the first bore holes are spaced apart one from another by a distance that can accommodate another similar sized bore hole therebetween and in a touching or near touching relationship therewith. Preferably, a sacrificial guide wall is be constructed at ground level and used to ensure that the first bore holes are formed with the correct spacing therebetween.

At step 902 a helical pile is installed within at least some of the plurality of first bore holes. The helical piles may be installed using a standard tracked or wheeled excavator with a torque motor attachment, which monitors the torque achieved during installation to verify the design. Generally, the helical pile comprises a hollow tubular shaft fabricated from steel or another suitable material. A lower portion of the shaft has helical flights that are designed to pull the helical pile into the ground material, without augering, when the helical pile is rotated about a longitudinal axis along the length of the shaft. As such, the ground material remains substantially in place and is not pulled up into the bore hole when the helical pile is being installed. The open lower portion of the shaft terminates in an angled pilot point, which assists in advancing the helical pile into the ground during rotation. Ground material fills the interior of the shaft as the helical pile advances into the earth. The upper portion of the shaft remains protruding out of the ground material at the bottom of the bore hole after the helical pile has been installed. Preferably, the upper portion of the shaft includes features that increase the contact between the helical pile and the concrete when the bore hole is filled. For instance, the shaft may have a plurality of through holes to provide fluid communication between the interior and exterior of the shaft. Further, the shaft may have a textured outer surface, or the shaft may have features such as rods or plates that extend away from the shaft and become embedded in the concrete when the bore hole is filled.

At step 904 each of the first bore holes is filled with concrete, either to approximately the ground surface level or to another predetermined level above or below the ground surface level. As will be apparent to one of ordinary skill in the art, suitable forms can be used to extend the level of the concrete above the ground surface level. Known techniques may be used to fill the first bore holes, such as for instance pouring the concrete into the first bore holes or pumping the concrete through a hose to the base of the bore holes.

The concrete in the first bore holes is allowed to cure at step 906. After curing, the hardened concrete in each first bore hole that has a shaft of a helical pile therewithin forms one concrete pile of the second type of concrete piles. On the other hand, after curing, the hardened concrete in each first bore hole that does not have a shaft of a helical pile therewithin, if any, forms one concrete pile of the first type of concrete piles. Preferably, the concrete that is used to form the second concrete piles has a compressive strength of 5 MPa to 20 MPa.

At step 908 a plurality of second bore holes is formed such that one second bore hole is formed between each pair of previously formed first bore holes. Preferably, the sacrificial guide wall is used to ensure proper location of each of the second bore holes. The second bore holes may extend to substantially the same depth as the first bore holes, or the second bore holes may be deeper or shallower than the first bore holes. For simplicity, it is assumed that the first bore holes and second bore holes are formed to an average depth $d_1$, and it is further assumed that any variation of the depth of individual bore holes from the average depth is not relevant to the principles discussed herein.

Referring now to step 910, a helical pile is installed within at least some of the plurality of second bore holes in a manner similar to that used to install the helical piles within at least some of the plurality of first bore holes as discussed with reference to step 902.

At step 912 the second bore holes are filled with concrete, either to approximately the ground surface level or to another predetermined level. In a manner similar to that used to fill the first bore holes with concrete as discussed with reference to step 904.

After curing, the hardened concrete in each second bore hole that has a shaft of a helical pile therewithin forms one concrete pile of the second type of concrete piles. On the other hand, after curing, the hardened concrete in each second bore hole that does not have a shaft of a helical pile therewithin, if any, forms one concrete pile of the first type of concrete piles. Preferably, the concrete that is used to form the second concrete piles has a compressive strength of 5 MPa to 20 MPa.

In combination, the concrete piles of the first type of concrete piles and the concrete piles of the second type of concrete piles form a tangent shoring wall in which the concrete piles are touching or nearly touching. The method that has been described with reference to FIG. 9 may be implemented with numerous modifications without departing from the scope of the instant invention. Several non-limiting examples of possible shoring wall configurations and helical pile placements are discussed below in more detail.

FIGS. 10A-10D through FIGS. 17A-17D illustrate the steps that are shown in FIG. 9, using the example of a shoring wall having a generally rectangular footprint around an excavation area 250. With specific reference to FIG. 10A, shown is a plan view of an excavation site prior to the excavation area 250 being excavated. FIGS. 10B, 10C and 10DC are cross-sectional views taken along the lines B-B, C-C and D-D in FIG. 10A, respectively. The dot-dash line "P" in FIGS. 10B, 10C and 10D corresponds to the plane "P" in FIG. 10A, which is aligned with the edge of the dashed line rectangle enclosing the excavation area 250. As is shown in FIGS. 10B, 10C and 10D, the ground surface "G" is substantially level. The height of the water table below the excavation area 250 is denoted in FIGS. 2B, 2C and 2D by the dashed line "W."

Referring now to FIG. 11A, shown is a plan view of the excavation site with a template for forming first bore holes 350*a* and 350*b* and second bore holes 352*a* and 352*b* around the perimeter of a dashed line rectangle, which encloses the excavation area 250. As shown in FIG. 11B and 11D, the first bore holes 350*a* and 350*b* (which are shown using solid lines in FIG. 11A) have been formed to a depth that is shallower than the water table height W but deeper than the required excavation depth of the excavation area 250. As shown in FIG. 11C, the second bore holes 352*a* and 352*b* (which are shown using dashed lines in FIG. 11A) have not been formed. As will be apparent, a guide wall structure or other physical template facilitates the planning and placement of the first bore holes 350*a* and 350*b* and the second bore holes 352*a* and 352*b*, such that the concrete piles formed therein are touching or nearly touching in the finished shoring wall.

Figures 12A, 12B, 12C, 12D:
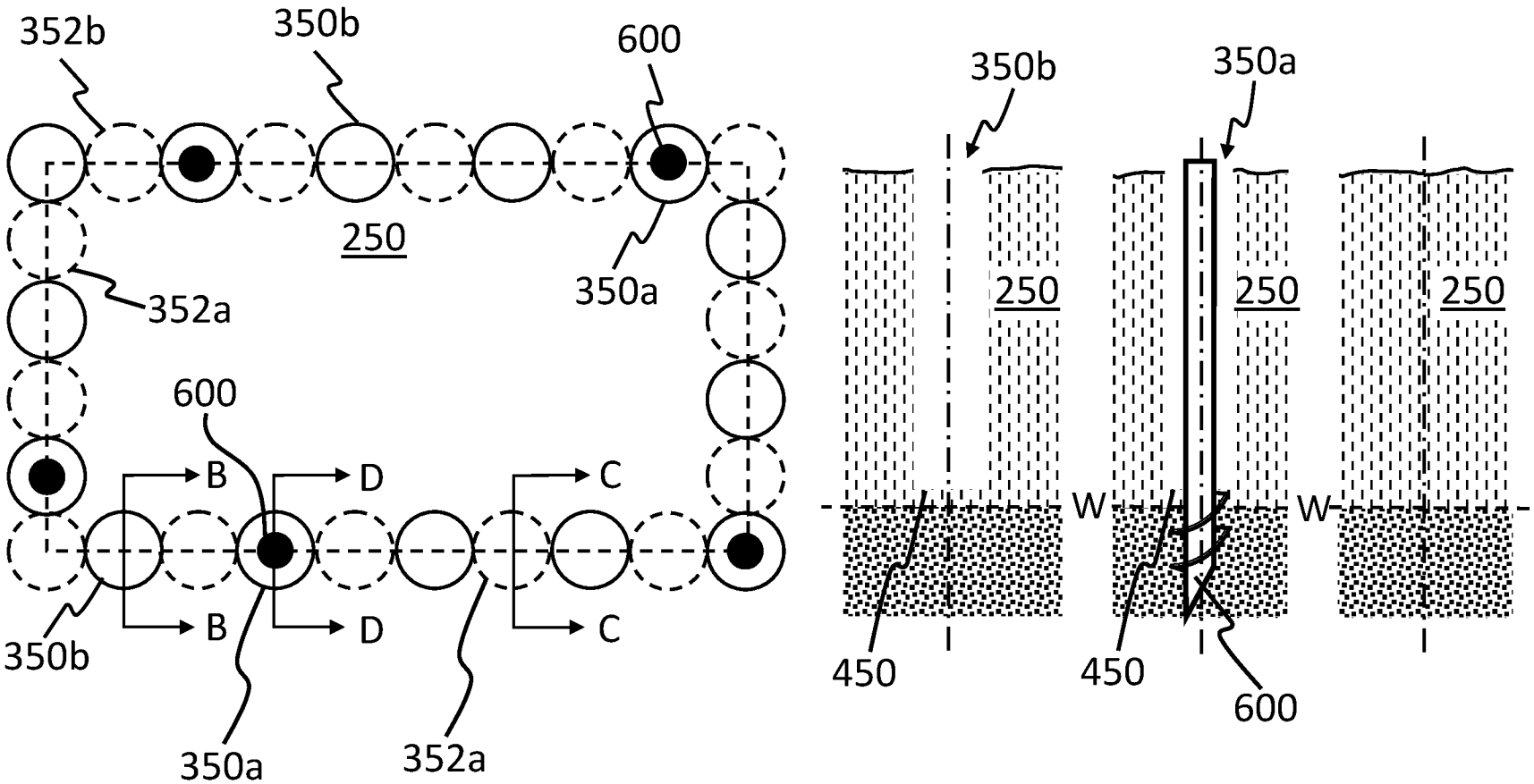
FIGS. 12A-12D show a plan view and cross-sectional views of the first excavation site after installing helical piles in some of the first plurality of bore holes.

Referring now to FIG. 12A, shown is a plan view of the excavation site after helical piles 600 have been installed within the first bore holes 350*a*, but not within the first bore holes 350*b*. As shown in FIG. 12D, the helical pile 600 is installed such that helical flights arranged along the lower portion of the shaft are embedded into the ground material below the bottom 450 of the first bore hole 350*a*. In this example, the lower portion of the installed helical pile 600 is disposed below the water table level W. Advantageously, the helical pile 600 is installed by rotating the shaft thereof so as to cause the helical flights to advance into the ground material below the bottom 450 of the first bore hole 350*a*. FIG. 12B shows one of the first bore holes 350*b* in which a helical pile is not being installed.

Referring now to FIG. 13A, shown is a plan view of the excavation site after the first bore holes 350*a* and 350*b* have been filled with concrete, as indicated by the diagonal fill lines in the drawings. As discussed with reference to step 904 of FIG. 9, the first bore holes 350*a* and 350*b* may be filled using any suitable technique, including pouring the concrete into the first bore holes 350*a* and 350*b* or pumping the concrete to the bottom of the first bore holes 350*a* and 350*b* using a hose. A suitable concrete mixture may be selected by one of ordinary skill in the art in order to achieve a final cured concrete pile having desired properties. Preferably, the concrete that is used to fill the first bore holes 350*a* and 350*b* has a compressive strength of 5 MPa to 20 MPa. As shown in FIGS. 13B and 13D, the first bore holes 350*a* and 350*b* may be filled between the bottom 450 thereof to approximately the ground surface level G. Optionally, the first bore holes 350*a* and 350*b* are filled to a level that is below the ground surface level G. Further optionally, forms are placed above ground surface level G to extend the column of concrete in the first bore holes 350*a* and 350*b* above ground surface level G.

After curing, the hardened concrete in each first bore hole 350*a* that has a shaft of a helical pile 600 therewithin forms one concrete pile 750 of the second type of concrete piles. Since the concrete fills in around the shaft of the helical pile 600, as shown in FIG. 13D, a secure connection is formed between the shafts of the helical pile 600 and the first concrete piles 750 of the second type of concrete piles after the concrete has hardened. On the other hand, after curing, the hardened concrete in each first bore hole 350*b* that does not have a shaft of a helical pile 600 therewithin forms one concrete pile 452 of the first type of concrete piles.

Referring now to FIG. 14A, shown is a plan view of the excavation site after the second bore holes 352*a* and 352*b* have been formed, as indicated using solid lines instead of dashed lines. As shown in FIGS. 14B-D, the second bore hole 352*a* is formed to a depth similar to the depth of the first bore holes 350*a* and 350*b*, such that the bottom 550 of the second bore hole 352*a* is approximately at the same depth below ground surface level G as the bottoms 450 of the first bore holes 350*a* and 350*b* (i.e., the above-mentioned average depth $d_1$). As shown in FIG. 14A the perimeter of each of the second bore holes 352*a* and 352*b* is tangent to, i.e., touching or nearly touching, the perimeter of two adjacent first bore holes 350*a* or 350*b*. The bore holes 352*a* and 352*b* are substantially identical to one another.

Referring now to FIG. 15A, shown is a plan view of the excavation site after helical piles 600 have been installed within the second bore holes 352*a*, but not within the second bore holes 352*b*. As shown in FIG. 15C, the helical pile 600 is installed such that helical flights arranged along the lower portion of the shaft are embedded into the ground material below the bottom 550 of the second bore hole 352*a*. In this example, the lower portion of the installed helical pile 600 is disposed below the water table level W. Advantageously, the helical pile 600 is installed by rotating the shaft thereof so as to cause the helical flights to advance into the ground material below the bottom 550 of the second bore hole 352*a*.

Referring now to FIG. 16A, shown is a plan view of the excavation site after the second bore holes 352*a* and 352*b* have been filled with concrete, as indicated by the diagonal fill lines in the drawings. As discussed with reference to step 912 of FIG. 9, the second bore holes 352*a* and 352*b* may be filled using any suitable technique, including pouring the concrete into the bore holes 352*a* and 352*b* or pumping the concrete to the base of the bore holes 352*a* and 352*b* using a hose. A suitable concrete mixture may be selected by one of ordinary skill in the art to achieve a final cured concrete pile having desired properties. Preferably, the concrete that is used to fill the bore holes 352*a* and 352*b* has a compressive strength of 5 MPa to 20 MPa. FIG. 16C shows the bore hole 352*a* may be filled between the bottom 550 thereof to approximately the ground surface level G. Optionally, the bore hole 352*a* is filled to a level that is below the ground surface level G. Further optionally, forms are used above ground surface G to extend the column of concrete in the bore hole 352*a* above ground level. The bore holes 352*b* may be filled in a similar fashion.

After curing, the hardened concrete in each second bore hole 352*a* that has a shaft of a helical pile 600 therewithin forms one concrete pile 750 of the second type of concrete piles. Since the concrete fills in around the shaft of the helical pile 600, as shown in FIG. 16D, a secure connection is formed between the shafts of the helical pile 600 and the first concrete piles 750 of the second type of concrete piles after the concrete has hardened. On the other hand, after curing, the hardened concrete in each second bore hole 352*b* that does not have a shaft of a helical pile 600 therewithin forms one concrete pile 452 of the first type of concrete piles.

Referring now to FIGS. 17A-17D, the use of helical piles 600 in the first bore holes 350*a* and in the second bore holes 352*a* gives the finished shoring wall greater strength by increasing resistance below the excavation level "E." This increased resistance is achieved without forming the first bore holes 350*a* and 350*b* or second bore holes 352*a* and 352*b* to a deeper depth, which in the instant example would require digging an open hole into water-saturated ground material below the water table level W. As will be apparent to one of ordinary skill in the art, digging an open hole into ground water containing soil is problematic since the soil tends to comprise fine or granular particles and is prone to collapsing into the bore hole.

Referring now to FIGS. 18A-C, shown are various non-limiting examples of shoring wall configurations that may be formed in accordance with an embodiment, in addition to the closed rectangular footprint discussed supra. FIG. 18A illustrates a substantially rectangular shaped shoring wall that is open along one side thereof. FIG. 18B illustrates a zig-zag shaped shoring wall. FIG. 18C illustrates a substantially linear shoring wall. In general, shoring walls having other closed (i.e., circular, triangular, etc.) shapes may be constructed and shoring walls having other open shapes, with linear and/or curved portions, may be constructed without departing from the scope of the invention. In addition, shoring walls having other patterns of placement of the first type of concrete piles 402/452 and second type of concrete piles 700/750 may formed without departing from the scope of the instant invention.

Figure 19A:
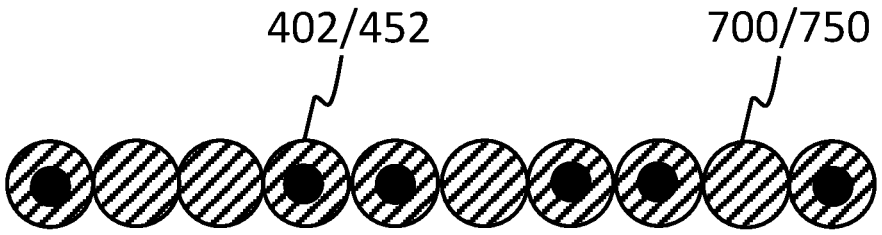
FIGS. 19A-19D show non-limiting examples of helical pile placement options in a portion of a straight section of a shoring wall.
Figure 19B:
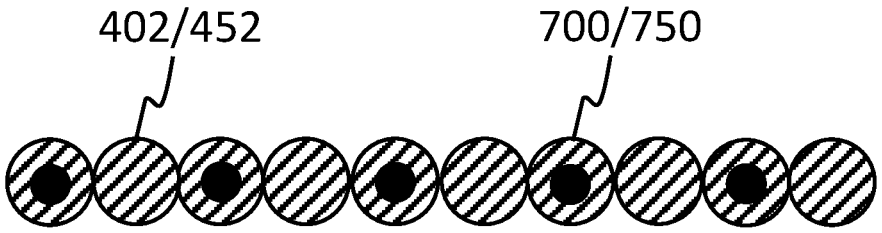
Figure 19C:
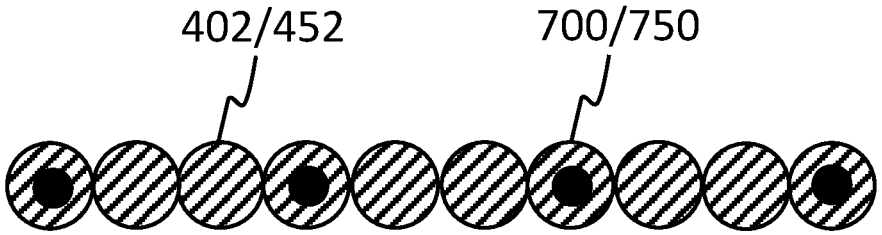
Figure 19D:
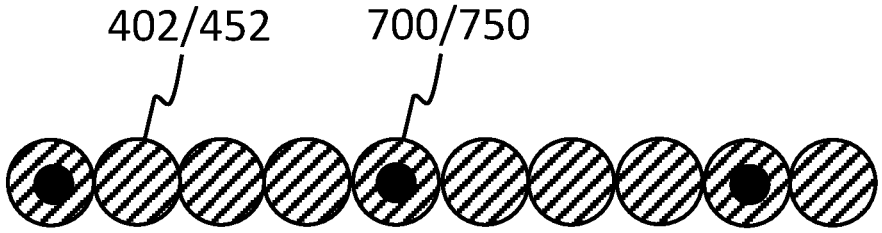

Referring now to FIGS. 19A-19D, shown are various non-limiting patterns for placing helical piles 600 along lengths of a shoring wall constructed according to an embodiment, resulting in different patterns of the placement of the first type of concrete piles 402/452 and second type of concrete piles 700/750. FIGS. 19A-19D show linear shoring wall sections, however the same principles may be adapted to other shoring wall configurations. For instance, FIG. 19A shows a shoring wall section having a higher concentration of second type of concrete piles 700/750 in a central portion thereof. Such a pattern may be desirable if an adjacent structure is located near the central portion of the shoring wall. FIG. 19B-19D show simple patterns in which every $n^{th}$ concrete pile has a helical pile 600 therewithin, i.e., it is a concrete pile 700/750 of the second type, wherein for instance the value of n is to be determined depending on the soil conditions etc. In FIGS. 19B-19D, n=2, 3, and 4, respectively. In general, the second type of concrete piles 700/750 includes 10% and less than 50% of the tangent concrete piles in a finished pile shoring wall according to an embodiment.

Throughout the description and claims of this specification, the words "comprise", "including", "having" and "contain" and variations of the words, for example "comprising" and "comprises" etc., mean "including but not limited to", and are not intended to, and do not exclude other components.

It will be appreciated that variations to the foregoing embodiments of the disclosure can be made while still falling within the scope of the disclosure. Each feature disclosed in this specification, unless stated otherwise, may be replaced by alternative features serving the same, equivalent or similar purpose. Thus, unless stated otherwise, each feature disclosed is one example only of a generic series of equivalent or similar features.

All of the features disclosed in this specification may be combined in any combination, except combinations where at least some of such features and/or steps are mutually exclusive. In particular, the preferred features of the disclosure are applicable to all aspects of the disclosure and may be used in any combination. Likewise, features described in non-essential combinations may be used separately (not in combination).

What is claimed is:

1. A method of constructing a pile shoring wall, comprising:

forming a plurality of tangent concrete piles in the ground and along an edge of an area that is to be excavated to an excavation depth, comprising:

forming a plurality of first concrete piles in the ground at depths wherein the average depth is $d_1$; and forming a plurality of second concrete piles which includes 10% and less than 50% of the tangent concrete piles, wherein forming each second concrete pile comprises:

forming a bore hole in the ground, the bore hole having a bottom at a depth below ground surface level that is deeper than the excavation depth;

installing a helical pile into ground material below the bottom of the bore hole, such that a shaft of the helical pile protrudes upwardly from the ground material and into the bore hole; and at least partially filling the bore hole with concrete such that the concrete fills around the protruding shaft of the helical pile and forms a column of concrete defining one of the second concrete piles.

2. The method as defined in claim 1, wherein forming each first concrete pile comprises:

forming a bore hole in the ground, the bore hole having a bottom at the depth $d_1$ below ground surface level; and absent a step of installing a helical pile into ground material below the bottom of the bore hole, at least partially filling the bore hole with concrete such that the concrete forms a column of concrete defining one of the first concrete piles.

3. The method as defined in claim 2, wherein installing the helical pile into ground material below the bottom of the bore hole comprises rotating the helical pile about a longitudinal axis thereof until a toe of the helical pile is at least about 2 m below $d_1$.

4. The method as defined in claim 2, wherein each second concrete pile is spaced from a next second concrete pile by one or more first concrete piles.

5. The method as defined in claim 2, wherein forming the plurality of tangent concrete piles comprises forming at least three wall portions defining a perimeter wall.

6. The method as defined in claim 2, wherein forming the plurality of tangent concrete piles comprises forming at least four wall portions defining a perimeter wall having a closed shape.

* * * * *